US007204212B2

(12) United States Patent
Donaldson

(10) Patent No.: US 7,204,212 B2
(45) Date of Patent: Apr. 17, 2007

(54) CAMLESS ENGINE HYDRAULIC VALVE ACTUATED SYSTEM

(75) Inventor: Joshua Donaldson, Chambersburg, PA (US)

(73) Assignee: Temic Automotive of North America, Inc., Deer Park, IL (US)

( * ) Notice: Subject to any disclaimer, the term of this patent is extended or adjusted under 35 U.S.C. 154(b) by 0 days.

(21) Appl. No.: 11/033,784

(22) Filed: Jan. 12, 2005

(65) Prior Publication Data

US 2006/0150935 A1 Jul. 13, 2006

(51) Int. Cl.
*F01L 9/02* (2006.01)

(52) U.S. Cl. ..... 123/90.12; 123/90.13; 123/90.14; 123/90.27

(58) Field of Classification Search ..... 123/90.12, 123/90.13, 90.14, 90.27
See application file for complete search history.

(56) References Cited

U.S. PATENT DOCUMENTS

| | | | | |
|---|---|---|---|---|
| 4,898,078 | A | 2/1990 | Gage et al. | |
| 5,339,777 | A | 8/1994 | Cannon | |
| 5,531,192 | A | 7/1996 | Feucht et al. | |
| 5,572,961 | A * | 11/1996 | Schechter et al. | 123/90.12 |
| 6,067,946 | A | 5/2000 | Bunker et al. | |
| 6,092,495 | A * | 7/2000 | Hackett | 123/90.15 |
| 6,263,842 | B1 | 7/2001 | De Ojeda et al. | |
| 6,308,690 | B1 | 10/2001 | Sturman | |
| 6,315,265 | B1 | 11/2001 | Adler et al. | |
| 6,520,130 | B2 | 2/2003 | Chiappini et al. | |
| 6,701,879 | B2 * | 3/2004 | Diehl et al. | 123/90.22 |
| 2002/0161541 | A1 | 10/2002 | Hou et al. | |
| 2004/0211378 | A1 * | 10/2004 | Diehl et al. | 123/90.13 |
| 2005/0005881 | A1 * | 1/2005 | Diehl et al. | 123/90.12 |

OTHER PUBLICATIONS

Schechter, Michael M. et al..: "Camless Engine", SAE Technical Report 960581., Warendale, PA: Society of Automotive Engineers, Inc., 1996, pp. 622-636.

Mardell, J.E., et al.: An Integrated, Full Authority, Electrohydraulic Engine Valve and Diesel Fuel Injection System, SAE Technical Report 880602, International Congress and Exposition, Detroit, Michigan, Feb. 29-Mar. 4, 1988, pp. 1-10.

Wilson, Rob: Camless in Colorado, Automotive Industries, Issue: May 2004, http://www.ai-online.com/issues/article_detail.asp?id=464, pp. 1-3.

Stone, Richard and Eric Kwan: Variable Valve Actuation Mechanism and the Potential for their Application, SAE Technical Report 890673, Warrendale, PA: Society of Automotive Engineers, pp. 1258-1274.

Donaldson, Joshua M.: Dynamic Simulation of an Electrohydraulic Open Center Gas-Exchange Valve Actuator System for Camless Internal Combustion Engines, Submitted to Faculty of Milwaukee School of Engineering, Milwaukee, Wisconsin, May 2003, published Jan. 2004, pp. 1-137.

* cited by examiner

*Primary Examiner*—Thomas Denion
*Assistant Examiner*—Zelalem Eshete

(57) ABSTRACT

A method and apparatus for hydraulically actuating a gas exchange valve using a low-pressure, substantially constant flow fluid source applied to at least one actuator cylinder piston coupled to the gas exchange valve. The actuator piston slides within the actuator cylinder upon application of pressure from the fluid for actuating the gas exchange valve. The pressure is continuously variable and builds upon application to the cylinder piston until the valve unseats. A pressure sensor is used to monitor the pressure to provide feedback about the operation of system and to provide variable motion control of the gas exchange valve.

18 Claims, 23 Drawing Sheets

CAMLESS ENGINE HYDRAULIC VALVE ACTUATED SYSTEM

FIELD OF THE INVENTION

This invention is generally directed to hydraulic actuation of gas exchange valves.

BACKGROUND OF THE INVENTION

List Of Abbreviations

ATDC After Top Dead Center (Engine Piston)
ATF Automatic Transmission Fluid
BDC Bottom Dead Center (Engine Piston)
bhp Brake Horsepower
BTDC Before Top Dead Center (Engine Piston)
CLE Camless Engine
EC Exhaust Close (GEV)
EH Electrohydraulic
EHOCVA Electrohydraulic Open Center Valve Actuator
EO Exhaust Open (GEV)
EPA Environmental Protection Agency
GEV Gas Exchange Valve
IC Intake Close (GEV)
ICE Internal Combustion Engine
Intake Open (GEV)
IRP Integral Regenerative Piston
LPM Liters Per Minute
PZT Piezoelectric (Multilayered lead zirconium titanate)
RPM Revolutions Per Minute
SAE Society of Automotive Engineers
SV Solenoid Valve
TDC Top Dead Center (Engine Piston)

Nomenclature $A_{gv}$ effective gas pressure area of gas-exchange valve
$A_s$ hydraulic spool valve flow area
$C_d$ orifice flow coefficient
$c_r$ hydraulic spool valve radial clearance
$C_{spool}$ hydraulic spool valve circumference
$D_{gv}$ gas-exchange valve diameter
$F_{gvx,0}$ gas-exchange valve spring preload
$l_s$ hydraulic spool valve length
$P_{gp}$ engine cylinder gas-pressure
$P_h$ hydraulic pressure
Q hydraulic pump flow rate
Re Reynolds characteristic number
$S_g$ specific gravity of oil
$t_{SL}$ actuator electrical signal lead-time
$t_{VE}$ engine GEV time reference
V volume
$V_{sys}$ hydraulic system total effective volume
μ absolute fluid viscosity
ν kinematic fluid viscosity
ρ fluid density Internal combustion engines have typically been made with a mechanical valve drive train. The valve drive train can include a camshaft driving a push rod, driving a rocker arm, driving a spring loaded gas exchange valve. The gas exchange valve can control either an intake flow or an exhaust flow. This configuration requires at least two of these valve drive trains per cylinder. Driving all of these mechanical parts drains a significant amount of engine power, thereby lowering efficiency. Alternatively, a camshaft can be used to directly drive the gas exchange valve through a valve adjuster. Although this has a shorter mechanical path, the cost is increased due to the need for more camshafts, and there is still a mechanical drain of engine power that lowers efficiency.

Camless engines have been introduced that have independent gas-valve actuators which can control the valve with sufficient force, and require only a small percentage of engine output power. These actuators include electrical and hydraulic configurations. Existing electrical systems require a considerable amount of electrical energy, which in itself drains engine power through the alternator or other power source. In addition, the electrical systems are quite costly. Existing hydraulic systems all require the use of a constant high-pressure fluid source that requires the running of a high pressure pump at all times, which also drains engine power, particularly at idle. It would be beneficial if a camless system with improved efficiency can be provided at a low cost, particularly in view of the trends toward downsized gas and diesel engines requiring high fuel efficiency and high specific power output.

What is needed is an actuator system for camless internal combustion engines that provides an improvement in performance, size, and power efficiency. The actuator system should be able to be used on either intake or exhaust gas exchange valves. It would also be an advantage if a low cost system can be provided that overcomes the problems associated with the prior art.

BRIEF DESCRIPTION OF THE DRAWINGS

The features of the present invention, which are believed to be novel, are set forth with particularity in the appended claims. The invention, together with further objects and advantages thereof, may best be understood by making reference to the following description, taken in conjunction with the accompanying drawings, in the several figures of which like reference numerals identify identical elements, wherein:

DETAILED DESCRIPTION OF THE PREFERRED EMBODIMENTS

The present invention provides a novel electrohydraulic gas-exchange valve actuator system for camless internal combustion engines, with apparent advantages over existing systems. The actuator system could be used on either intake or exhaust gas exchange valves (GEV). The electrohydraulic actuator system described herein is referred to as Electrohydraulic Open Center Valve Actuators (EHOCVA). A configuration of required system components is presented and dynamic simulation included which demonstrate many improvements from the standpoint of performance, packaging, and power efficiency.

Based on consideration of valve actuation cycles and hydraulic power efficiency, an open-center hydraulic system schematic with series valves is presented. Compact valve actuation and hydraulic spool-valve components are described which would be suitable for typical engine layouts. With this configuration, hydraulic system simulation models were developed to predict the dynamic performance, power consumption, and tolerance to the temperature range and operating conditions of the application.

The modeling results demonstrate that the electrohydraulic actuator of the present invention may require as little as 1–2% of engine output power to operate. In contrast, technical journals estimate the power input for comparable prior art systems at 4–7% of engine output. This improvement in input power requirements affects the overall fuel efficiency and net gain of camless engines. Additionally fluid temperature variation was found to have reduced impact in this system compared to prior-art metering systems. Simulation results indicate the system may lend itself well to open-loop control, which would improve cost and reliability significantly by eliminating position sensors on each valve.

The wide range of existing EH CLE (Electrohydraulic camless engine) actuator systems utilize a constant-pressure hydraulic source, metering the fluid through valves to get the desired flow-rates and actuator speeds. There are several reasons constant pressure systems are widely used. Primarily, since there is pressure available to all actuators concurrently, they can work in parallel if the required flow is available. Since the system is kept at a high pressure, actuator response is fast because oil is already at pressure and compressed when applied to loads by the valves. Additionally, it allows accumulators to be used, supplying peak flow demands. However, keeping the system at high pressure drains engine power, which is particularly noticeable at idle speeds.

Figure 3:
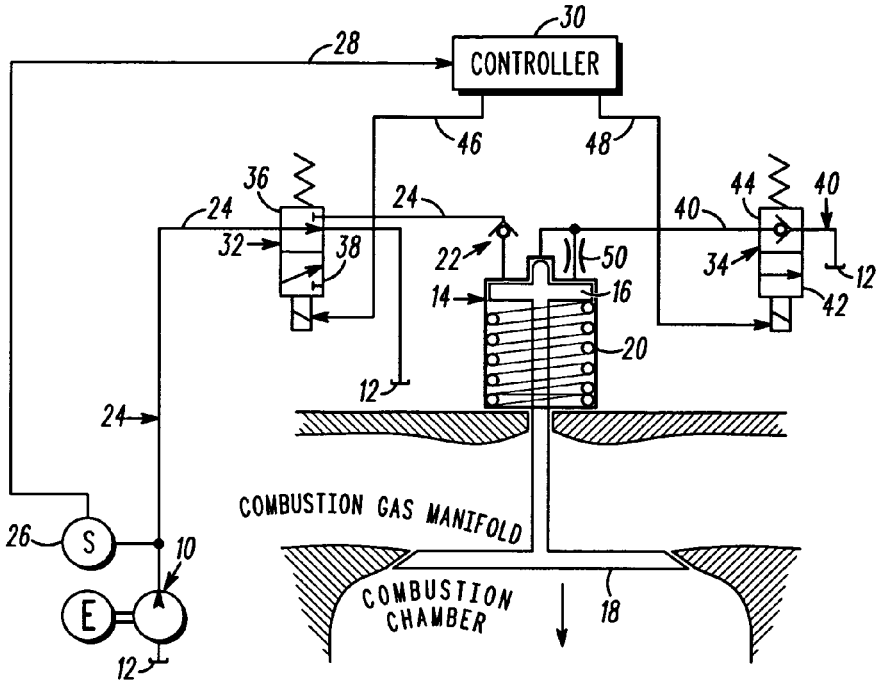
FIG. 3 shows a schematic diagram of an EHOCVA module, in accordance with the present invention.
Figure 38:
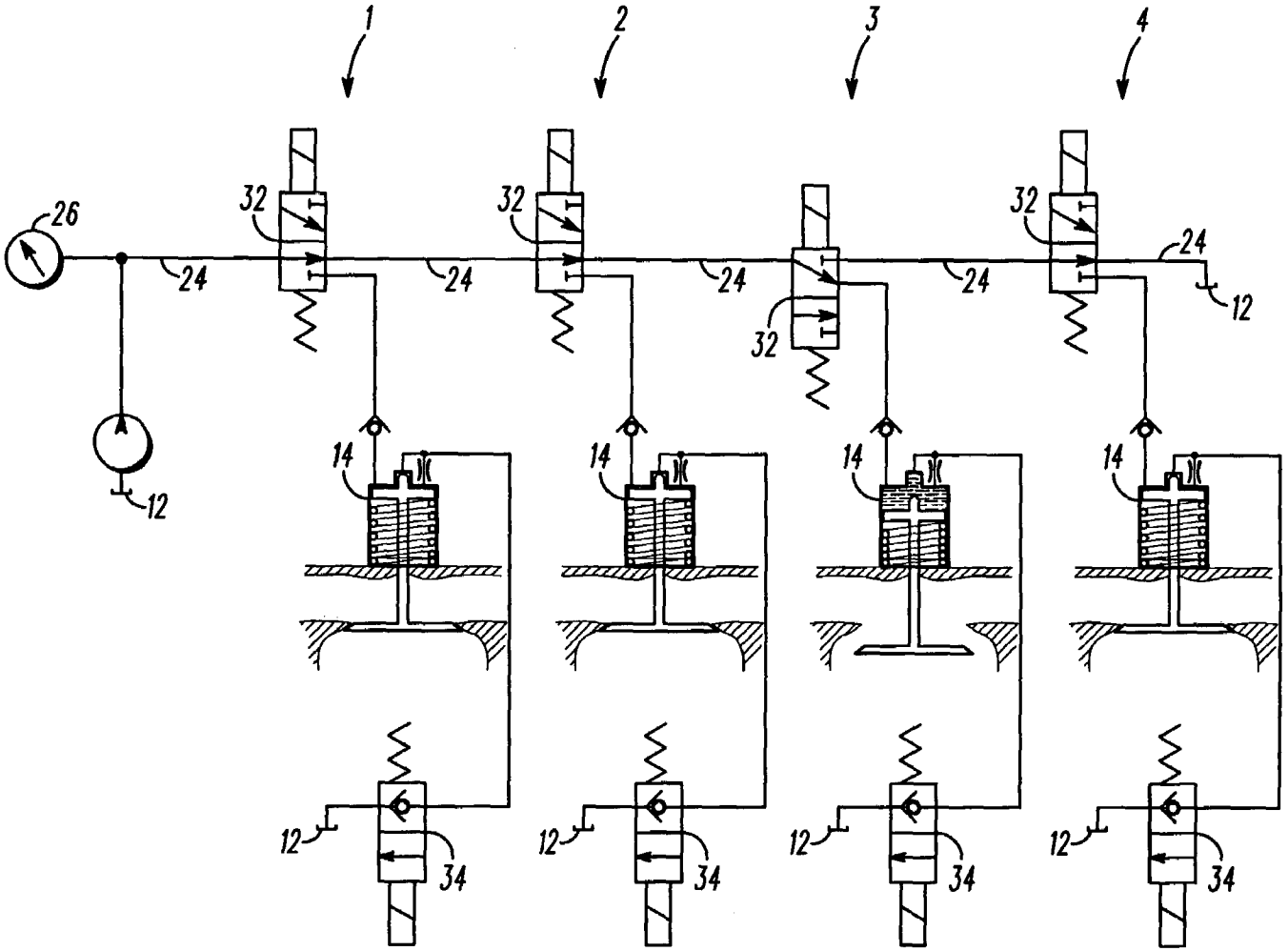
FIG. 38 shows a schematic diagram of an EHOCVA system using the modules of FIG. 3, in accordance with the present invention.

The system of the present invention, shown in FIG. 3 and FIG. 38, is in contrast a constant-flow or 'open center' system. The pump flow goes freely through all valves at minimal pressure when actuators are not being used. This has several advantages for the application, and little of the disadvantages of the prior art. Due to the open-center design, flow to the actuators is approximately a fixed rate, determined by the pump output rather than orifice flow through valves at a fixed pressure. This is important because if the actuator speeds are predictable, GEV lift can be controlled more precisely, particularly in the case of open-loop control. Predictable open-loop systems are preferable when cost and reliability are important, because there are less sensors and control mechanisms involved.

In contrast, constant-pressure systems, without closed-loop control, may have lower actuator predictability particularly when fluid viscosity varies. Flow rates are viscosity dependent in such a metering system, apparent from the smaller discharge coefficient at low Reynolds numbers. When the fluid viscosity changes due to the introduction of different fluids, contamination, or temperature changes, pressure drop through lines can result in lower pressure available at the actuator valves and variance in actuator behavior.

An additional advantage shown to be inherent in the EHOCVA system of the present invention is high power efficiency. Although most CLE actuators will result in an increased net power output of the engine, the amount of hydraulic power required to operate them varies. Many are inefficient because of excess pump flow generated at system pressure. If the power drawn from the engine to operate the valve system can be decreased, it directly increases the engine power available to do useful work. Engine power to operate such systems is generally referred to as parasitic loading, which reduces fuel mileage.

Figure 1:
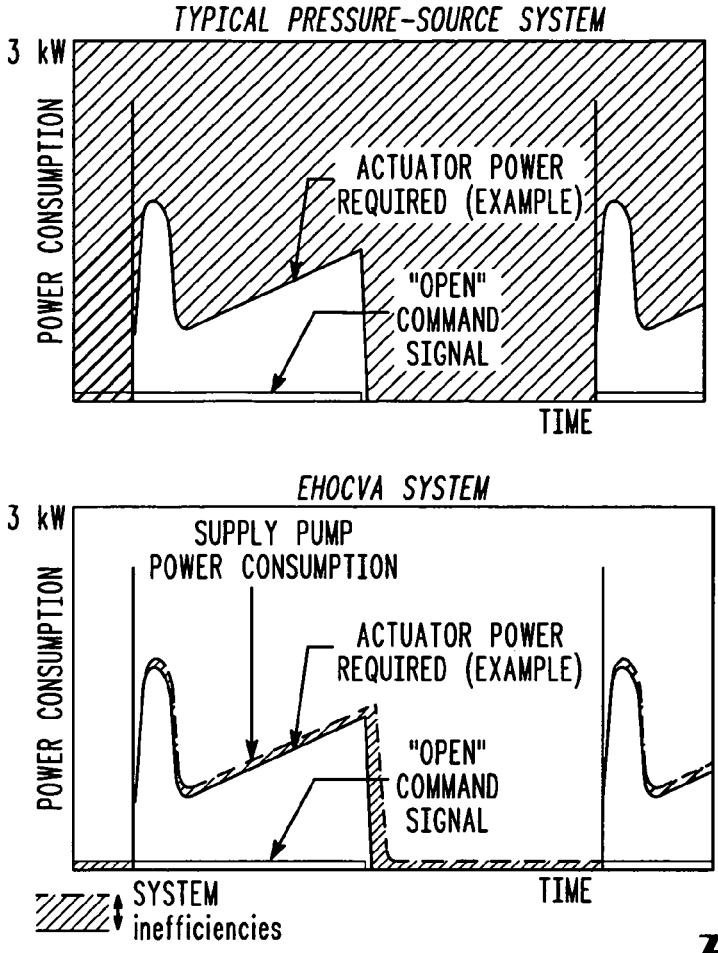
FIG. 1 is a graphical representation of the conceptual power consumption comparison between a prior art system (top) and the present invention (bottom)

An example illustration of the conceivable relative power levels for a prior art system (top) and the EHOCVA system (bottom) of the present invention is shown over a full valve cycle is shown in FIG. 1. Although this illustration is only an example, the relative power utilization comparison is accurate. The constant power consumption of the top figure represents a constant-pressure system with a positive-displacement pump. Any flow not metered to the actuators would be pushed over a relief valve at maximum pressure. Additionally, the inefficiency in the prior art (top diagram) increases at lower engine speeds, when the time between valve opening events is greater. This is an important point because maximum efficiency is desirable for highway cruising (low engine speeds).

The proposed system of the present invention also allows a means for bleeding air from the hydraulic circuit. Some systems, such as certain diesel fuel-injection systems, require service technician procedure for air bleeding. Eliminating these procedures is important for both production and maintenance reasons.

For these reasons, the constant-flow EHOCVA system can be useful for commercial applications. If the total hydraulic power required to run the system is low enough, other feasible configurations than described herein can be possible, such as a DC electric motor pump drive. This would have an averaging effect on the power consumption of the actuator system from the engine, increasing peak engine output (bhp) power ratings. The electric motor driven pump could also potentially improve engine startability.

Electrohydraulic valve actuators are an enabling technology for new engines under development by automotive manufacturers called 'Camless Engines', which have no camshaft for valve control. Instead, each valve is independently controlled for infinitely adjustable timing, lift, and phasing. This is known to allow optimum control of combustion for increased efficiency and decreased pollution. It also eliminates the conventional valvetrain components, allowing for much more flexibility in engine layout and configuration. Collateral benefits are numerous and may result in weight and size reduction of the engine.

Figure 2:
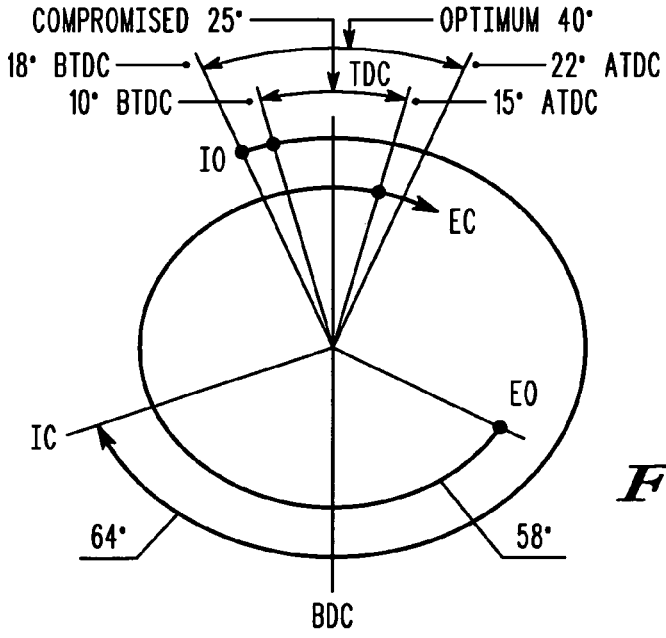
FIG. 2 typical petrol and diesel 4-stroke engine valve timing.

A conventional overhead valvetrain includes intake and exhaust valves for each cylinder, as are known in the art. In a four-cycle engine, the exhaust valve is closed (inactivated) and the intake valve is opened (activated) during an intake stroke. The exhaust valve and intake valve are inactivated during compression and power strokes. Finally, the exhaust valve is activated and the intake valve is inactivated during an exhaust stroke. The valves are each open for approximately 180° of engine crank rotation, which can be equated to 5 ms at 5000 RPM. The actual duration and timing varies from this slightly, with more exact typical points being shown in FIG. 2.

An intermediate technology that offers CLE benefits to a limited degree is referred to as Variable Valve Actuation (VVA). It is achieved in general by mechanically shifting cam lobes being used. Virtually all vehicle manufacturers are either exploring or using VVA engine technology. An example of this is a system by Eaton Corp. to be introduced in 2004 model year GM products. Hydraulic coupling devices are used to deactivate valves on selected cylinders, effectively turning the cylinders into air springs that do not consume fuel in low-power cruising modes. This intermediate technology illustrates some additional ways that CLE actuators can be used to increase engine fuel efficiency.

Electrohydraulic CLE valve actuators have also been described by Sturman Industries, primarily for medium to large-sized diesel engines. International Truck and Engine Corp. has also announced plans to use them in their line of diesel engines. Currently, the incentive to apply the technology to diesel engines is high for several reasons: new EPA emissions laws pertaining to diesel engines; marginal fuel efficiency improvements are highly valued by truck fleet owners; powerful independent valve actuators can reduce the cost of engines by eliminating extra components related to compression-release braking systems on large diesel engines. Another extensive EPA emissions reduction law applicable to large diesel engines has been announced for the year 2007. Other automotive industry companies are working to develop cost-effective valve actuator systems and electronics to make them feasible for wide-scale usage. A competing technology, direct electromagnetic actuation, is also proving feasible in many applications. These require different electrical requirements and are believed to be pending in next-generation 42-volt electrical systems in vehicles, however.

There are many examples of CLE Electrohydraulic actuators that have been proposed. One class of springless GEV actuators uses a throttled hydraulic fluid to force the GEV in both directions at a desired rate, depending on the coil-driven hydraulic valve position. Another class of EH CLE actuators include the typical GEV spring to force the GEV closed and maintain a gas seal. In all cases, a high pressure fluid source is supplied to actuate the GEV. The actuator design of the present invention is of the latter class of EH CLE actuators. However, a constant high-pressure source is not required.

The basic operation of each type of spring-return actuator is very similar. All of them control displacement of the GEV by filling or voiding a fluid chamber above the GEV in a controlled manner. Most include a means of decelerating the valve when it is near its closed position, which is necessary to avoid the mechanical stresses and noise of impact. For example, a type of hydraulic snubber can be used to restrict oil flow and thereby decelerate the valve near its seat. However, these designs still operate with a throttled high-pressure source.

It should be noted that various claims are made to the advantages and disadvantages of these two different classes of actuators. Springless EH actuators can use smaller hydraulic piston areas and have an overall smaller moving mass, resulting in efficiency gains. Although the single-action type requires a higher pressure or larger area in order to force the valve open against a spring, it can be done with less numerous valving components, and thus it is typically a more cost-effective choice with higher reliability. Further, a spring-type actuator allows the gas valve to be held in the closed position for long periods (e.g., cylinder deactivation) without a sustained hydraulic force being applied.

Many simulations of CLE EH actuators have been done both in industry and in academia. The results of many of these simulations illuminate the difficulty of achieving consistent valve operation, because of factors such as oil viscosity variations, usually due to temperature changes. For example, variations in a 4 mm valve stroke were found to be in the range of 0.02 mm to 0.05 mm. These variations were attributed to oil flow rate, electrical coil current, and control pulse variations. In addition, oil viscosity effects at low temperatures (−40° C.) require increasing solenoid activation times by much as 120% to achieve full valve actuation at a provided system pressure. This can be interpreted to mean the gas valve opened at half the desired speed at low oil temperatures (with a fixed system pressure). These operational variations are addressed in the present invention as described below.

In the past years, efforts have intensified to develop an economical and well-performing gas exchange valve (GEC) actuator to be used in production vehicles. Two primary demands drive these development efforts: stringent new automotive exhaust emission laws and fuel efficiency improvements. Camless engines (CLE) are being studied to address these demands. Although designs of CLE GEV actuators have been proposed for many years, dynamic simulation has only recently been made possible by powerful computers and mathematical solution software such as MATLAB® and AMESim®. Mathematical simulation of hydraulic systems requires extensive knowledge of physics, fluid dynamics, and energy or Newtonian equations. Not surprisingly, dynamic analysis can be used to evaluate the performance and control of the CLE GEV actuator designs.

Regardless of the type of hydraulic systems used, an important common element for design and simulation is the fast actuation needed of the hydraulic valves. Engine valve opening times can be as small as 6 ms, with the hydraulic valve required to open in as little as 1 ms. This is an extremely fast speed for conventional solenoids, although fast solenoids have been developed at considerable effort. Another promising technology for achieving the fast valve actuation is piezoelectric (PZT) stack actuators, wherein a supply voltage of 100V and a displacement-amplification of 5:1 can provide a hydraulic valve displacement of 150 μm. PZT stacks can offer extremely fast actuation times, measured in fractions of a millisecond. The use of PZT or fast solenoids can be used to advantage in the present invention, as will be detailed below.

It is obvious that any approach to EH CLE valve actuator design has both benefits and drawbacks. The actuation system of the present invention utilizes some common features from the prior art, but further explores the use of a constant-flow hydraulic source. In contrast, all prior art configurations utilize throttled flow from a constant-pressure hydraulic source to control actuator velocity. The use of a constant flow source in the present invention improves operating efficiency over the prior art, and performance advantages would be gained with an open-center type system, particularly in low-temperature, low engine speed, or cylinder-deactivation conditions.

The EHOCVA Camless engine GEV actuation system of the present invention was configured for potential commercial applications, using predefined criteria. At the same time, component size and cost had to be reasonable considering the application. Thus, the system and component (module) configuration were equally important, although it should be recognized the system configuration largely determines the required power input.

The module configuration of the present invention is represented as shown in FIG. 3 using ISO hydraulic symbols. Although electrical solenoids are shown as the hydraulic valve actuators, the present invention does not preclude the use of other valve actuators, such as PZT stacks, two-stage (piloted spool) activation, or other drive configurations.

The schematic of FIG. 3 describes the basic module, function and flow paths of an apparatus for hydraulically actuating a gas exchange valve, in accordance with the present invention. A fluid source 10 is coupled with a fluid reservoir 12 or tank that holds the fluid. The fluid source 10 is operable to provide a low-pressure, substantially constant flow of fluid. At least one actuator cylinder 14 is coupled with the fluid source 10. The actuator cylinder 14 contains an actuator piston 16 therein coupled to the gas exchange valve 18. The actuator piston 16 is loaded by a return spring 20 and is operable to slide within the actuator cylinder 14 upon application of pressure from the fluid applied thereto from the fluid source 10 through a check valve 22. The pressure of the fluid on the piston 16 and against the return spring 20 actuates the gas exchange valve 18, as will be detailed below.

A fluid supply line 24 is coupled between the fluid source 12 and the actuator cylinder 14. A pressure sensor 26 is connected to the fluid supply line 24 near the pump 10. A controller 30 inputs a signal 28 from the pressure sensor 26 to monitor a pressure of the fluid to provide feedback about the operation of the gas exchange valve 18. The controller 30 controls the application of low-pressure, constant flow fluid to the actuator cylinder 14 such that the pressure in the cylinder 14 begins to rise to operate the actuator piston 16 to open the gas exchange valve 18 from a seated position (as shown). Preferably, the controller 30 uses the monitored pressure of the fluid for variable motion control of the gas exchange valve 18.

In a preferred embodiment, the present invention includes an inlet device 32, such as the solenoid-driven, spring-loaded spool valve shown, in the fluid supply line 24 before the actuator cylinder 14. The inlet device 32 has at least two operable stages, a first stage 36 wherein low-pressure fluid is allowed to freely pass through the inlet device 32 to return to the fluid reservoir 12 (as shown) while blocking any return flow from the actuator cylinder 14, and a second stage 38 wherein the fluid is directed through the inlet device to the actuator cylinder 14 through check valve 22.

Preferably, the present invention can also include an outlet device 34, such as the solenoid-driven, spring-loaded spool valve shown, after the actuator cylinder 14 along an exit fluid line 40. The outlet device 34 has two operable stages, a first stage 44 wherein the outlet device closes off flow from the actuator cylinder 14, such as by use of a check valve (as shown), and a second stage 42 wherein the outlet device allows fluid from the actuator cylinder to pass through to return to the reservoir 12.

Using feedback from the pressure sensor 26, the controller 30 can control operation of both the inlet and outlet devices 32, 34 with respective control signals 46, 48. In a preferred embodiment, the inlet and outlet devices 32, 34 can be switched to their respective first stages to hold the gas exchange valve at any one of a range of positions. In this way, variable valve operation and variable opening can be provided.

Optionally, a hydraulic snubber 50 can be coupled between an outlet of the actuation cylinder 14 and the outlet device 34. In addition, the inlet and outlet devices can be switched to their respective second stages to provide fluid flow through the actuator cylinder to purge air from the system.

In a further preferred embodiment, the module of FIG. 3 can be incorporated into a multi-actuator system, as shown in FIG. 38. The system includes a plurality of actuator cylinders 14 each with an associated inlet device 32. In this system, the inlet devices 32 are mechanically coupled in series along the fluid supply line 24, wherein those inlet devices operating in the first stage (shown as actuator 1, 2 and 4) freely pass the fluid to the next inlet device in the fluid supply line with the last inlet device (4) in the line passing the fluid to the reservoir 12. Where any one actuator is activated (3 as shown) this temporarily interrupts the flow to the next actuator downline (4) while that actuator is activated. Therefore, if any valve is actuated, then none of the downstream valves can be actuated. Ordinarily, this is not an issue since intake or exhaust valves in a bank of an engine (as shown) operate at different times. However, this may be an issue in multi-valve engines, wherein the drive systems of FIG. 18 would be duplicated as needed. Also, as shown, the system includes the plurality of actuator cylinders each with an associated outlet device 34. The outlet devices 34 are mechanically coupled in parallel from each actuator cylinder 14 to a fluid reservoir 12, wherein each outlet device operating in the first stage (as shown) can block fluid flow to build up pressure in an actuated valve (3), and any outlet device operating in the second stage can pass fluid from its actuator cylinder to the reservoir 12.

Figure 39:
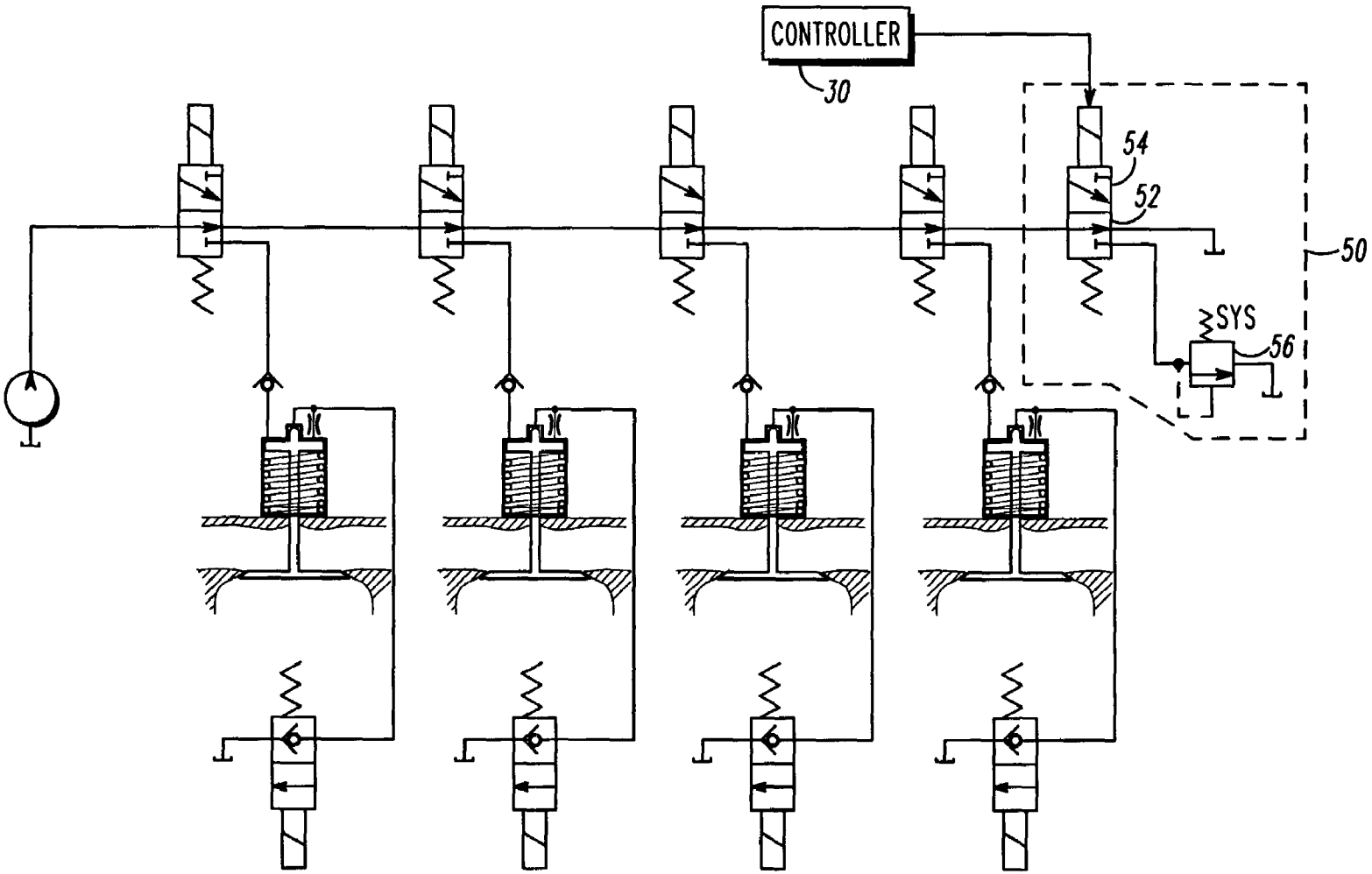
FIG. 39 shows a schematic diagram of an optional EHOCVA system using the modules of FIG. 3, in accordance with the present invention.

In an optional embodiment, shown in FIG. 39, the system of FIG. 38 can be provided with selectable high-pressure operation. This can be accomplished by adding a switchable pressure valve 50 coupled on an outlet of the fluid supply line. The pressure valve 50 is switchable by the controller between a first stage 52 that allows the free flow of fluid to the reservoir (as shown) and a second stage 54 which forces the fluid through a pressure regulator to increase the operating pressure of the fluid in the apparatus.

This selectable high-pressure operation would be advantageous during high speed conditions (for example) to allow faster valve response. This would result in a higher continuous power consumption of the circuit when activated, so it is preferred to have this mode selectable by operation of the extra solenoid system 50. In normal low-speed operation, the solenoid valve would be in the position shown, operating identically to the system of FIG. 38. However, if this valve 50 is switched, flow would be forced to flow through a type of pressure valve 56 (a constant-pressure relief valve is shown), forcing the system pressure to stay high between valve events. A system with this configuration of selectable modes would also be advantageous for diesel engine compression braking modes, where high forces and high hydraulic pressures are required in short time periods.

For simulation, and referring back to FIG. 3, the actuator system's complete mechanical and hydraulic properties were modeled and suitable assumptions specified. For example, the 'open' spool valve 32 is a compact 2-position 3-way spool valve. The 'close' valve 34 is a 2-position 2-way spool valve. Each are sized and designed for minimum flow restriction and also minimum mass to improve actuation speed. The orifice 50 represents a hydraulic snubber. A snubber is a hydraulic device that decelerates a hydraulic cylinder at the end of stroke. Historically, a snubber is a common device for cylinders in the fluid power industry.

The present invention is configured to use a constant-flow, open-center hydraulic system, which is a point of departure from the prior art hydraulic CLE actuators that use a constant-pressure power source. There are several inherent advantages of this system, as will be described below. There are also limitations to be observed, namely fluid compressibility that can delay when the valves are actuated, and also the limitation of non-coincident valve actuation for the open-center system. These limitations can be managed by design and engine application strategies without compromising the performance.

This first phase of simulation involves the mechanical specification of all components, considering steady-state operation calculations and design requirements. Valves, springs, fluid lines, masses, and external forces were all specified which relate to the functions shown in the ISO diagram. This includes assumptions needed to approximate the pressure drops, flow rates, accelerations, frictional flow losses, spool damping, oil compressibility, springs, and engine cylinder pressure effects of an actual system.

The focus of the simulation is the mechanical and hydraulic components, with a gray-box approach to the electric hydraulic valve actuator. It is known that the spool valve transition will need to be extremely high speed, in the range of 1 ms or less. Specialized solenoids and PZT actuators have both been shown to have this capability. In addition, the hydraulic valve design will be influenced by the necessary high switching speeds. Further, the simulation had several prioritized objectives. They were: dynamic performance to meet the requirements of the application actuator system (function), total power efficiency, cost effectiveness, and simplicity (for reliability). The importance of each objective depends on a given vehicle application, but a balance can be achieved with the present invention.

A means for matching the hydraulic power pull of the system to the hydraulic requirements of the CLE actuator system is introduced in the simulation. For example, any hydraulic flow at high pressure that is not being used by actuators in prior art constant-pressure systems results in power loss in the form of heat generation at a relief valve. There are known ways of minimizing this inefficiency, such as using a variable displacement pump which would create only the flow required upon demand, or to have an adjustable relief pressure valve that reduces the pumping pressure when it is not required for actuation. Although these are common and effective methods of increasing efficiency of hydraulic systems, the high-speed operation of engines makes application of these ideas to CLE actuator systems extremely difficult or expensive. Further, higher component counts can statistically reduce reliability due to their complexity.

Performance specifications of a simulated actuator is largely determined by the engine speed. Fast opening speeds and low seating velocities, for example, are critical at high engine speeds. The primary performance and design specifications are summarized in Table 1.

TABLE 1

Design and Performance Specifications

| Specification | Target Value |
|---|---|
| Maximum engine speed | 5000 RPM |
| Gas valve diameter | 31 mm |
| Max. gas valve opening time (10–90%) | 2.5 ms |
| Max. gas valve lift | 9 mm |
| Residual gas pressure: exhaust | 10 bar |
| Initial volume of cylinder gas: exhaust | 0.7 L |
| Residual gas pressure: intake | 2 bar |
| Initial volume of cylinder gas: intake | 0.3 L |
| Max. gas valve seating velocity | 0.3 m/s |
| Max. hydraulic pressure | 300 bar |
| Oil operating temperature | −18 C. to 93 C. |

Figure 4:
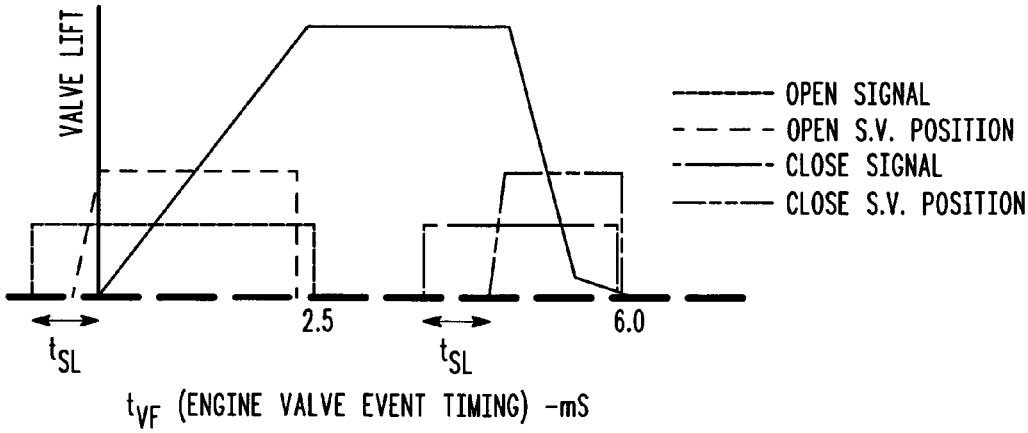
FIG. 4 shows a graphical representation of valve lift events with command signals.

The valve actuation performance specifications can be more readily described in a graph, such as FIG. 4. The sequence of GEV, hydraulic valve, and signal events can be seen to occur in small time periods, in the range of 2.5 ms for full GEV lift. This corresponds to the maximum engine speed of 5000 RPM.

Figure 5:
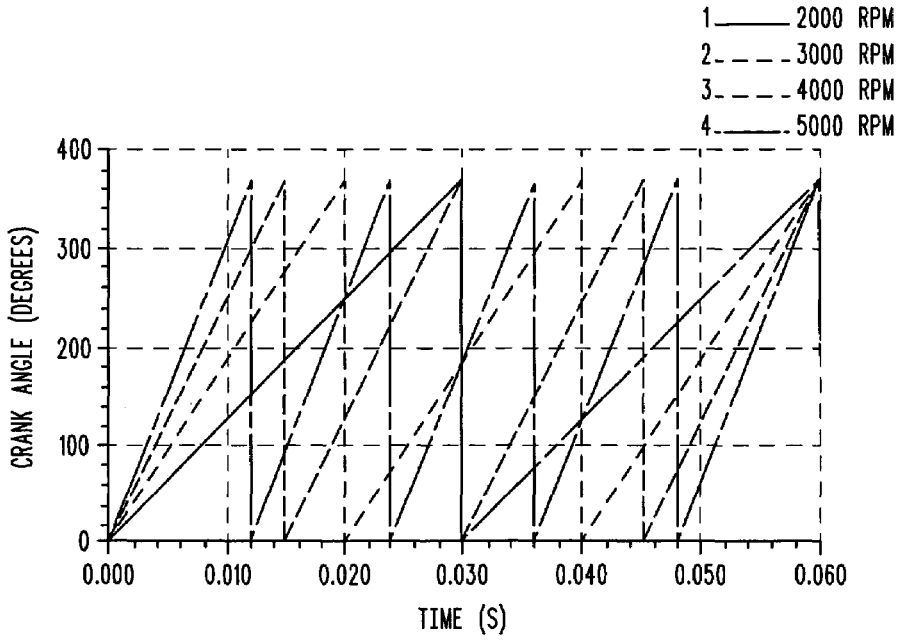
FIG. 5 shows a graphical representation of engine crank angle versus time.

The valve cycle times for this engine speed and other speeds are readily determined on a graph of engine crank angle versus time, such as FIG. 5. It is noted that full valve events occur during approximately 180-degrees of crank rotation (one piston stroke down for intake, or one piston stroke up for exhaust). By inspection of this graph, the gross total valve event time (180 degrees of crank rotation) in the 2000 RPM–5000 RPM range varies from 15 ms to 6 ms.

Fluid for this system is required to have high bulk modulus for quick response, but also be practical for automotive purposes. Among the choices considered were ATF (Automatic transmission fluid), antifreeze, and common engine oil. Engine oil was chosen because of its lubrication properties, bulk modulus properties similar to standard hydraulic fluids, and the flexibility it would allow in engine implementation. In other words, the engine oil sump could be the reservoir where return flow could potentially drain down through the engine as lubrication oil does if low aeration could be maintained. Fluid properties shown in Table 2 are commonly known, with the exception of absolute viscosity (μ), which was calculated according to:

$$\mu(cP)=S_g*\nu(cS)$$

TABLE 2

Fluid Properties
Assumed Fluid Properties (5W-20 Petroleum Oil)

| | Temperature | | |
|---|---|---|---|
| | −18 C. (Low) | 66 C. (Normal) | 93 C. (High) |
| β (Bulk Modulus) | 24,100 bar (0.5% Air) | 14,000 bar (0.5% Air) | 11,700 bar (0.5% Air) |
| ν (Kinematic) | 800 cS | 16.0 cS | 8.0 cS |
| μ (Absolute) | 800 cS | 16.0 cS | 8.0 cS |
| ρ (Density) | 900 kg/m$^3$ | 750 kg/m$^3$ | 700 kg/m$^3$ |
| Specific Gravity | 0.90 | 0.75 | 0.70 |

Figure 6:
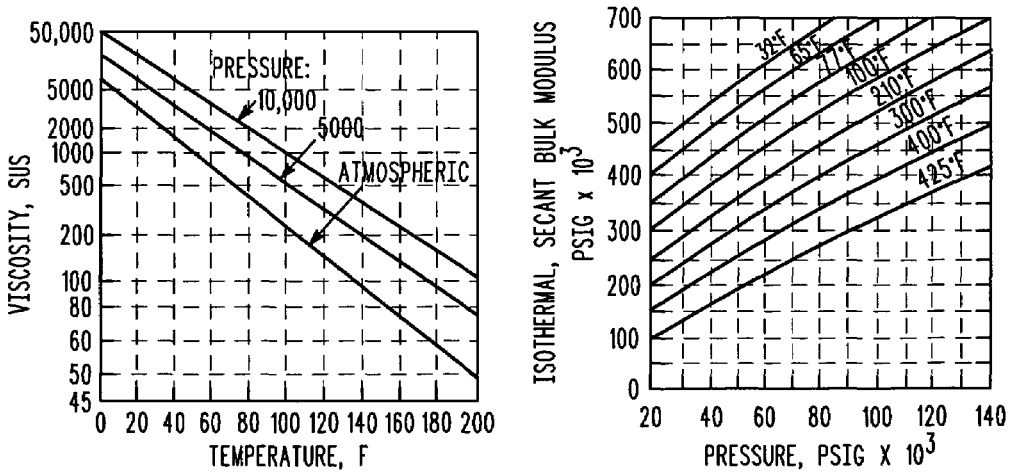
FIG. 6 shows graphical representations of the pressure dependence of viscosity and bulk modulus.

Comprehensive fluid properties were used in the dynamic model to calculate absolute viscosity, bulk modulus and density as a function of pressure and temperature. Ratios from the FIG. 6 were used to compile the pressure-dependent fluid properties. The mechanical properties of the system were then modeled.

Referring back to FIG. 3, the fluid supply line 24 plus any restrictions from other actuator modules of a system configuration affecting the total pressure losses of the system were included in the simulation. A pump flow rate for the system of 10 LPM was chosen and primary fluid passageways of the supply line were sized to minimize system volume (for response time), but not have excessive pressure drop. This flow rate is reasonable for a small automotive pump sized at 2 cm$^3$/rev. at 5000 RPM and the expected actuator's flow requirements.

Line sizes were chosen as in the following table, with their respective lengths, volumes, and characteristic Reynolds Number which was calculated by, $$Re=\frac{Vd}{\nu},$$

and estimating a 1.5 bar pressure drop in the line. Here V is fluid velocity, d is line diameter, and ν is kinematic viscosity. It is important to minimize system volume for this system due to the fact that system pressure fluctuates widely and fast actuator response is required. Table 3 also includes additional estimated system volumes for the input supply line and output supply line from the actuator cylinder, which would affect the actuator dynamics, such as pump chambers and miscellaneous volumes in the actuator module.

TABLE 3

System line lengths and volumes

| Line | d (cm) | L (cm) | V (cm/s) | Re (vs. viscosities) | Est. Δρ (bar) | Internal volume (cm$^3$) |
|---|---|---|---|---|---|---|
| Input | 0.6 | 50 | 590 | 4432/2216/44 | 0.9 | 14.1 |
| Output | 0.8 | 30 | 332 | 3324/1662/33 | 0.2 | n/a |

Additionally, it was assumed that internal volume of the inlet valve is 5.0 cm$^3$ and the actuator cylinder is 0.2 cm$^3$. A full valve actuator system would likely consist of separate circuits, such as shown in FIG. 38 for intake valves and exhaust valves. Each would have a dedicated pump, sized to provide the specified flow.

The actuators would be opened sequentially, according to the firing order of the engine. This may at first appear to be a system limitation, but a prior art power-efficient constant-pressure system would similarly not have sufficient flow to allow coincident actuator opening events. There are no limitations on the closing events of the system (all valves could coincidently be closed), and multiple valves could remain open if necessary, provided they are opened sequentially. These operating conditions have been considered at length, and there are no known desirable engine operating conditions in which this would not be suitable. In fact, the efficiency benefits of this system would likely outweigh the benefit of having the option of opening multiple valves coincidentally. It has also been estimated that a typical prior art constant-pressure system with a pump sized to allow multiple valve actuation coincidentally would consume equal multiples of continuous input power.

A resulting physical actuator design is an initial baseline design on which the dynamic simulation is based. Simulations resulted in distinct configurations for intake and exhaust valves because of their different operational requirements. The significant differences (variable lift and different cylinder gas pressures for intake valves and exhaust valves, respectively) can require differing actuator piston diameters. A goal was to minimize the overall size of the actuator, for realistic compatibility with engine layouts.

Figure 7:
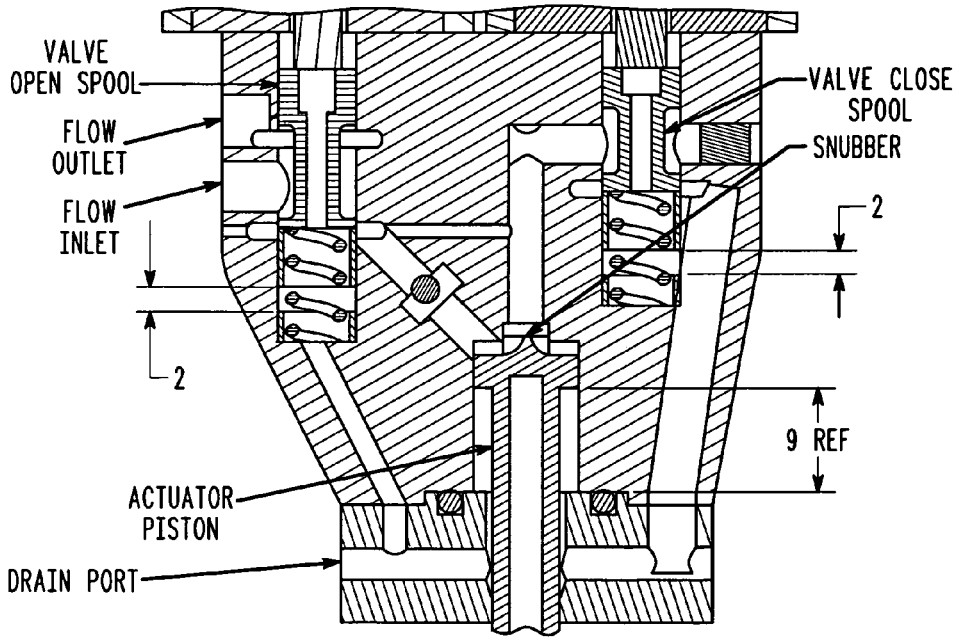
FIG. 7 shows a cross-sectional view of the assembled actuator module of FIG. 3.

FIG. 7 shows a cross-sectional view of the assembled actuator module. The overall dimensions of the module (above the spring) are approximately 68 mm×53 mm×26 mm. Fluid ports shown in these drawings are as an example. The fluid ports can also be located perpendicular to the cross-sectional view to allow direct inline plumbing between actuators, reducing line losses of pressure from elbows and bends. Another conceivable configuration is to have the spool valves directionally inline in the engine block, with outlets ported up to each actuator. This would minimize the potential for leaks and pressure drop through fittings.

The overall module internal design is shown with both fluid control spool valves, valve bodies, springs, and actuator piston. As dimensioned in this drawing, total valve spool travel is 2.0 mm, with 1.5 mm of land opening and the balance is overlap. This amount of spool travel resulted from a design goal of minimizing travel (for solenoid speed and minimum airgap) but having sufficient flow area for low pressure drop.

The design shown in FIG. 7 has three primary hydraulic ports, with 'flow inlet' being from the pump, and 'flow outlet' would connect to the flow inlet of additional actuators. These are the straight-through ports shown in valve 32 of the schematic of FIG. 3. The shown 'drain port' provides an exhaust port for valve closing and drains the spool valves to prevent pressure accumulation in either end of the spool. A dynamic seal would be required on the piston at the bottom, although not shown.

After initial modeling, density properties of spools and the piston were assigned to the model, which allowed mass to be determined. This is the mass used in simulation models and shown in Table 4. All components are high-carbon steel. Optimum spring constants (K) and initial forces ($F_0$) in the table were determined during simulations. The objective in sizing the spring was to provide sufficient force to accelerate the spool closed within 1 ms, but not provide excessive force for the solenoid to open against. Further design concepts to reduce or eliminate the spring force would allow faster valve response.

TABLE 4

Component Mass and Spring Properties

| Component | Mass (kg) | K (N/mm) | B (N/m/s) | $F_0$ (N) |
|---|---|---|---|---|
| Open spool | 2.1e−4 | — | 0.31 | — |
| O.S. spring | — | 4 | — | 5 |
| Close spool | 1.7e−4 | — | 0.31 | — |
| C.S. spring | — | 4 | — | 5 |
| Actuator piston | 6.01e−4 | — | 0.12 | — |
| Gas valve | 4.0e−3 | — | — | — |
| Gas valve spring | 3.0e−3 | 20 | — | 35 |

The gas valve spring was sized in a way similar to the spool valve springs. First, an estimated size based on current engine valve springs was used, then adjusted based on simulation results to accelerate the valve closed in the required time period, but not provide excessive resistance during opening. For the gas valve, this meant a closing time of approximately 2 ms.

One consideration for engine valve actuators is the control of seating velocity for low impact stress and noise. For maximum reliability and consistency of seating velocity, a snubber design was used which produces a decelerating pressure in the piston chamber just prior to seating. Snubbers are ideal in such a situation as this where the physical load and velocities involved are known and relatively consistent. In such a situation, the design can be optimized for the exact conditions. The primary variable, then, is the fluid properties in varying temperature conditions.

Figure 8:
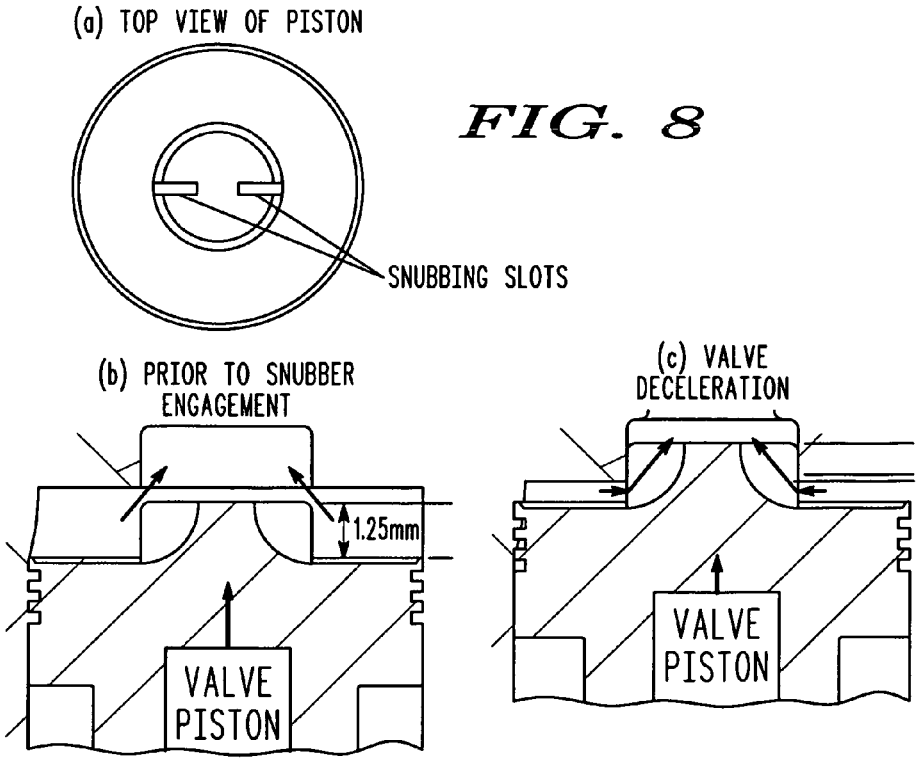
FIG. 8 shows operational views of a snubber design.

A slotted plunger type was chosen and is illustrated in FIG. 8. The benefit of this design is the gradual reduction of the oil outlet flow area, and the resulting gradual deceleration. Although it is not an idealized linear decelerator, it has a reasonable tradeoff of manufacturability and ideal performance. Ideal cylinder snubbers used a hyperbolically shaped plunger. Actual dimensions for the chosen snubber design can be determined through modeling. The snubber would need to be optimized separately for an exhaust valve with a larger hydraulic piston area. Modeling results of the snubber performance over the specified temperature range are detailed below.

An optional application of the present invention is an Integral Regenerative Piston. For example, a valve actuator design obstacle, particularly with diesel engines, is the high gas pressures encountered in the cylinder when the valve is required to open. This gas pressure imparts high loads on the valve, for example, during compression braking when the valve must open near top dead center after a compression stroke.

One solution to this is to provide regenerative flow theories wherein a large hydraulic piston area is allowed in initial stages of valve lift, but reduced effective piston area and higher speeds during the remainder of the actuation cycle. This would allow reduced hydraulic pressure and flow to open the valves quickly, resulting in significant power savings and improved seating-velocity control.

Figure 9:
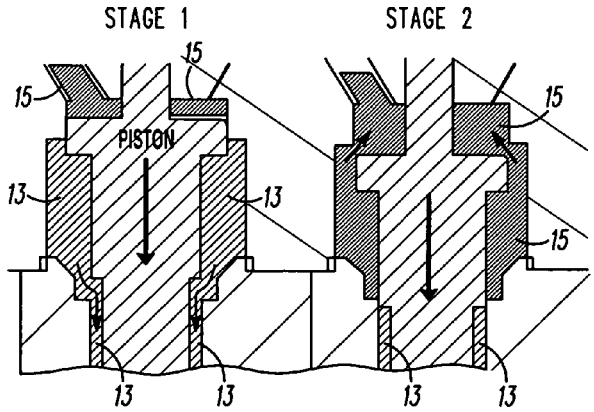
FIG. 9 shows operational views of an integral regenerative piston, in accordance with the present invention.

The operation of this is best explained by referring to FIG. 9 and noting the area which the high pressure 15 acts on. In stage '1', the pressure is low 13 below the piston, causing the high pressure 15 to effectively act on the entire top area. In stage '2', after the valve move a sufficient amount, the high pressure acts on both the top and bottom portions of the piston (reducing the effective area in the direction of motion). In stage '2', an accompanying result is an increase in valve opening speed (piston velocity).

The concept could be used with any type of hydraulic valve actuation system, although the advantages are most significant in engines with high cylinder gas pressures, such as large diesels. For the valve specifications used in the present invention (small gasoline and diesel engines), it was decided this configuration would not significantly benefit the performance considering the added complexity and cost. However, simulations were performed for large diesel engine specifications, where improvements were discovered and utilized in the model.

Figure 10:
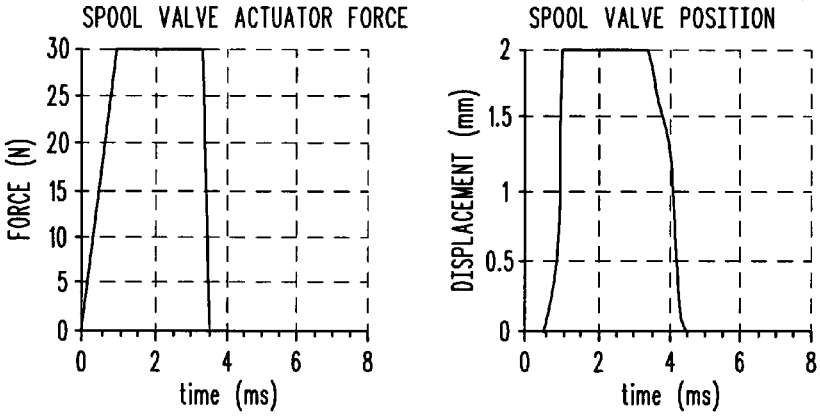
FIG. 10 shows a graphical representation of the minimum activation force and position of a hydraulic spool-valve.

Specialized spool-valve activation is necessary for this application, and achievable in a number of ways. Some obvious options are piezoelectric stacks (sometimes called piezoelectric motors), two-stage hydraulic activation, or a single direct-acting solenoid with sufficient speed. The simulations in following sections assume a minimum specified input force, which can be used to devise suitable spool-valve activation components. The minimum spool-valve force found to be sufficient in simulations for 1 ms activation is shown in FIG. 10, which includes mass, spring and flow-force effects on the spool.

Figure 11:
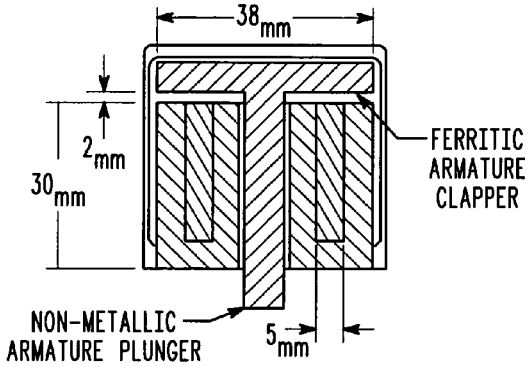
FIG. 11 shows a cross-sectional view of a high-force solenoid.

With these determined activation forces, the feasibility of a direct-acting solenoid was considered. A potential design is shown in FIG. 11. The target performance was a minimum 10 N initial force, 20 N hold-in force, and 1.0 ms flight time. The design shown should provide a force of 75 N at a current density (J) of 1.5E7 Amperes/$m^2$ and a flux density (B) of 2 Tesla. This confirms the option of direct spool activation.

In the initial stages of a valve-lift event, oil pressure rises at a linear rate determined only by the system bulk-modulus (β), supply flow rate (Q) and system volume (V) as in:

$$\frac{dp}{dt} = Q\frac{\beta}{V}$$

Bulk modulus is an oil property, determined by air entrainment, temperature, and immediate pressure. It is desirable to maximize the pressure rise-rate and one way of doing this apart from oil selection and aeration control is to minimize system volume. Line diameters have been minimized for the given flow-rate in the system to minimize volume, but elimination of length of lines reduces volume and additionally reduces line pressure-drop.

As a way of reducing line lengths and volume (in the pressurized region), pump location is considered. By locating the pump closer to the actuators (such as an overhead pump), total line length which must be pressurized for a valve event is reduced significantly. The pump is envisioned in an engine valve-cover type containment and driven through a shaft-seal as a contingency for potential leaks. It would be desirable and perhaps necessary to precharge the pump inlet with a low-pressure source of oil, such as a submerged reservoir pump. This would reduce the likelihood for cavitation, particularly in low-temperature conditions when viscosity and line-losses are high. As an option to such an overhead belt-driven pump, an electric motor driven pump (either as a replacement or for supplemental flow) could be located close to the actuators in a similar way. Elimination of 50 cm of 6 mm-diameter fluid line in the pressurized region equates to a relatively significant system volume reduction of 14.1 $cm^3$ (relative to the total volume of this system).

After the steady-state specification and mechanical design phase, the simulation model was constructed in AMESim® software using a sequential build method. Core mass, spring, and hydraulic components were first modeled, and operation sequences established. Next, all significant effects such as friction, flow losses, compressibility, and cylinder residual pressures were added. Before doing in-depth analysis, the model was used to compare the effects of piston diameter. Optimum diameters for the given configurations were then chosen. The model had in excess of seventeen state variables and ten energy-storage elements.

Modeling focused on a single actuator module but with the major system effects included. Since the objective was to model the dynamic capabilities of the concept valve actuator system to determine feasibility, reasonable assumptions were made in areas outside of the stated study and purpose. These assumptions included a specified solenoid actuation force on the spool valves, linear spring constants, and rigid-walled fluid tubing. Spring constants are considered linear in the 0–0.5 normalized displacement range. The spring constant would naturally increase to a maximum of infinity at a fully compressed state.

The hydraulic piston is designed with a radial clearance seal (rather than a dynamic seal) for durability as in fuel injectors. This results in a viscous damping force, estimated by:

$$F_f = \frac{\mu \pi d l_s v}{c_r}$$

Using a piston radial clearance ($c_r$) of 8 μm, diameter (d) of 8.5 mm, length ($l_s$) of 3 mm, and absolute viscosity (μ) of 12 cP, estimated viscous friction for the piston would be 0.12 N/m/s. Similarly, friction for the spool valves was estimated to b e0.31 N/m/s (as in Table 4).

With the mechanical design, specifications, and friction estimates completed, object-oriented modeling was possible in AMESim®, which allows modeling of systems such as this by defining the relationship of basic elements, such as masses, valve metering lands, springs, orifices, mechanical stops, pressure areas, etc. The mathematical equations linking these elements were used to validate the expected results, as described below. The model layout mirrors the module design (FIG. 7) as far as component positions. The 'Open Spool' consists of two metering lands; the 'Close Spool' consists of only one. Required input forces on the spool valves were approximately 35 N max, and 30 N sustained when the valve was to be shifted.

Results of simulations need validation measures before being considered credible results. Comparing critical dynamic and static values with hand-calculated values at particular points is a means of doing this when experimental results are not available. Dynamic motion of the gas valve, hydraulic bulk modulus effects, and valve flow rates were the dominant factors in the system. Sample results for each were verified at a midpoint of the response with known mathematical relations. The model was validated with parameters as listed in Table 5, although slightly different than the final design values.

TABLE 5

Model Validation Parameters

| Parameter | Verified Model Value |
|---|---|
| $m_{gv}$ (Total valve and piston mass) | 0.02 kg |
| $b_{gv}$ (Valve viscous friction) | 10 N/(m/s) |
| $k_{gvs}$ (G.V. spring rate) | 25 N/mm |
| $F_{gvs,0}$ (G.V. spring preload) | 30 N |
| $D_{hp}$ (hydraulic piston diameter) | 8.5 mm |
| $D_{gv}$ (G.V. diameter) | 32 mm |
| $P_{gv,res}$ (Residual Cylinder Pressure) | 2 bar |
| Q (hydraulic supply flow rate) | 12 LPM |
| B (system fluid bulk modulus) | 17000 bar |
| ρ (fluid density) | 850 $kg/m^3$ |
| $F_{sys}$ (effective hydraulic system volume) | 0.0202 L |
| Open spool major diameter | 6.5 mm |
| Open spool minor diameter | 3.5 mm |
| Open spool underlap (fully open) | 1.5 mm |
| $C_d$ (Valve flow coefficient) | 0.625 (turbulent flow, sharp-edge orifice) |

Figure 12:
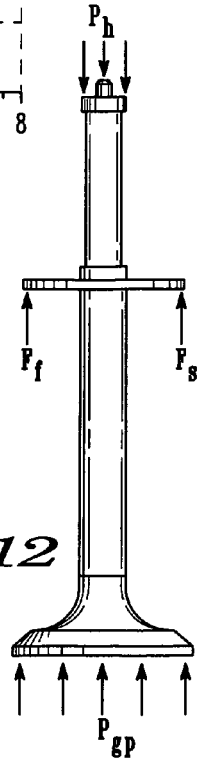
FIG. 12 shows a side view of the forces on the valving.

The motion of the gas-valve, piston, and spring assembly is mathematically described by Newton's Law, where the net force on a mass causes it to accelerate. FIG. 12 shows the four dominant forces on this valve resulting from hydraulic pressure ($P_h$), cylinder gas pressure ($P_{gp}$), viscous friction ($F_f$), and the valve spring ($F_s$). When oil is directed into the hydraulic piston chamber, the mass inertia, spring, and cylinder gas pressure resist movement and determine the hydraulic pressure.

At any point in time during motion, the pressure reflects these other forces and the mass acceleration. This force balance was used as one of the validation checks of the model at an arbitrary point. The gas pressure force and spring force are combined as $F_{ext}$. This is done for convenient comparison with the model in which these forces were combined for graphing purposes.

Referring to FIG. 12, and using Newton's equation force=mass*acceleration, the hydraulic pressure would be:

$$P_h = \frac{a_{gv} m_{gv} + F_{ext} + F_f}{A_{hp}},$$

Where $a_{gv}$ is acceleration of the valve assembly, $m_{gv}$ is mass, and $A_{hp}$ is effective area of the hydraulic piston. Each of the values in the right-hand side of this equation can be calculated for a given valve position, velocity, acceleration, and parameters specifications listed in Table 5. These is then calculated and compared at points shown in FIG. 13, which is the beginning of a valve lift cycle.

Figure 13:
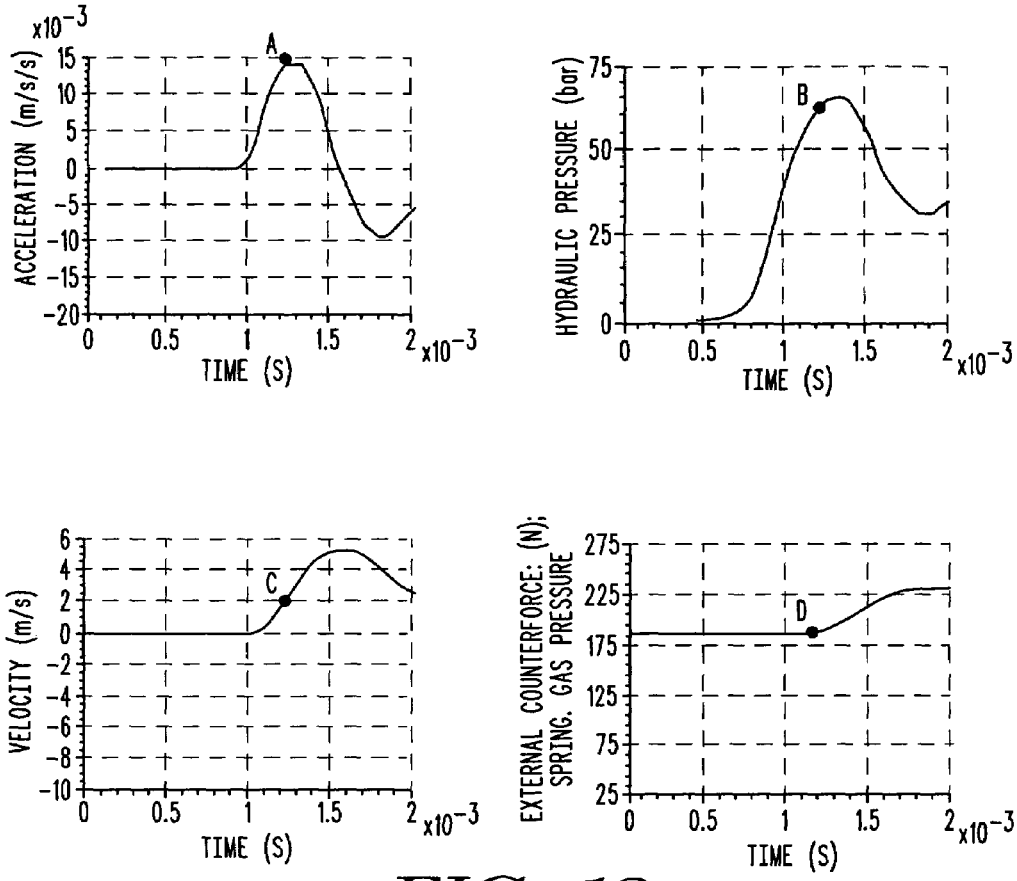
FIG. 13 shows graphical representations of gas valve dynamics validation data.

The external force data shown at this point is verified by calculating the gas-pressure force and spring force, using the specified original gas pressure ($p_{gp}$) of 2 bar, initial spring force $F_s$ of 30 N, and gas valve area ($A_{gv}$):

$$F_{ext}=F_s+A_{gv}*p_{gp}=30N+160.8N=190.8N,$$

which agrees with point 'D' of FIG. 13 of these results.

Next, friction force $F_f$ is estimated as $$F_f = v_{gv} * b = 2\ \frac{\text{m}}{\text{s}} * 10\ \frac{\text{N}}{\text{m/s}^2} = 20\ \text{N},$$

where $v_{gv}$ is the gas-valve velocity and b is the viscous damping coefficient used in this validation run. Velocity at this point is obtained from the results data (point 'C' of FIG. 13). Using valve acceleration indicated by the model (point 'A' of FIG. 13), the final term needed to estimate expected hydraulic pressure is $$a_{gv} m_{gv} = 15E3\ \frac{\text{m}}{\text{s}^2} * 0.01\ \text{kg} = 150\ \text{N}$$

Finally, these values and $F_{ext}$ estimate the hydraulic pressure should be $$P_h = \frac{150\ \text{N} + 190.8\ \text{N} + 20\ \text{N}}{5.67\ \text{mm}^2} = 6.08\ \text{MPa} = 60.8\ \text{bar},$$

in agreement with the simulation data pressure (point 'B' of FIG. 13).

This portion of the validation shows that the intended forces and pressures on the valve are correctly predicted by the model, and provides confidence in the results at other points.

5.1.1 Oil Bulk Modulus Dynamics

The system of the present invention is particularly affected by the oil bulk-modulus (β), which determines the change in volume (ΔV) of the fluid depending on change in pressure (ΔP), with an initial volume V as quantified by:

$$\frac{\Delta V}{V} = -\frac{\Delta P}{\beta}.$$

Rearranging and considering Q (flow rate in) to cause a negative (−) change in volume, $$\frac{dp}{dt} = Q\frac{\beta}{V}$$

is a form which is directly observable in the results data. It estimates a rate of change of pressure for a given flow rate, bulk modulus, and system volume as the oil compresses or decompresses.

First using the system volume, bulk modulus, and fluid flow rate specified in Table 5 for this validation model, the expected pressure-rise rate can b estimated for comparison to simulation results by substituting values, $$\left.\frac{dp}{dt}\right|_{theoretical} = Q_{hyd}\frac{\beta}{V_{total}}$$
$$= 2 * 10^{-4}\ \frac{\text{m}^3}{\text{s}} * \frac{17 * 10^8\ \frac{\text{N}}{\text{m}^2}}{2.02 * 10^{-5}\ \text{m}^3}$$
$$= 168{,}317\ \frac{\text{bar}}{\text{s}}$$

Figure 14:
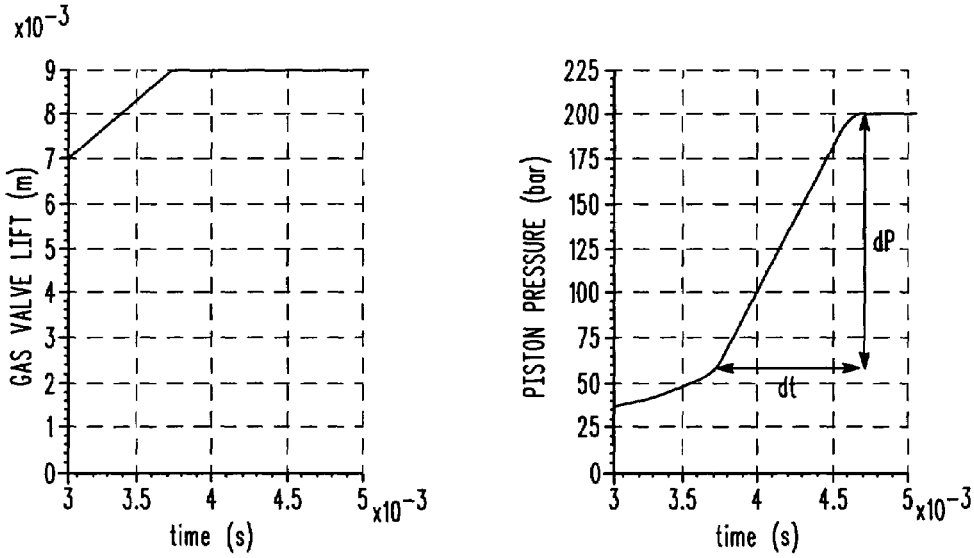
FIG. 14 shows a graphical representation of oil compressibility results validation data.

To determine the pressure rise-rate of the simulation model for comparison to these expected results, the system volume is fixed by having the actuator fully extended to the 9 mm stop. This is shown by the left side of FIG. 14, wherein at the corresponding time (about 3.7 ms), the pressure begins to rise linearly as expected. This rise rate is calculated by dividing the indicated measurements, dP and dt which are approximately 145 bar and 0.9 ms respectively. The result is $$\left.\frac{dp}{dt}\right|_{simulation} = \frac{\Delta p}{\Delta t} = \frac{+145\ \text{bar}}{0.9\ \text{ms}} = 161{,}111\frac{\text{bar}}{\text{s}},$$

which corresponds to the expected value and provides further confidence in the results.

Investigating the flow areas of the Open spool, it was determined that the flow was limited by the annular flow area, as opposed to the area of the valve land opening. This is shown as follows:

$$A_{s,land} = C_{spool} * x = 2\pi(D_{spool})(x) = 30.47\ \text{mm}^2$$
$$A_{s,annular} = \pi\left(\frac{D_{spool,major}}{2}\right)^2 - \pi\left(\frac{D_{spool,minor}}{2}\right)^2 = 23.55\ \text{mm}^2$$

therefore $A_{s,annular} < A_{s,land}$.

Calculating the flow corresponding to this area and the pressure-drop through the valve, as shown in the following simulation graph, is accomplished by:

$$Q_h = C_d A_{s,annular}\sqrt{\frac{2\Delta p_h}{\rho_{oil}}}. \tag{10}$$

where $C_d$ is the flow coefficient (assumed to be 0.625 for turbulent flow), $A_s$ the spool flow area, and Δp the differential pressure. Substituting values from specifications, the shown flow areas, and the pressure drop indicated by points 'A' and 'B' on FIG. 15 estimate the flow should be $$0.625(23.55 * 10^{-6})\text{m}^2\sqrt{\frac{2(1.0\ \text{bar})(10^5)}{850\ \text{kg/m}^3}}\text{, which is}$$

$$26(10^{-4})\frac{\text{m}^2}{\text{s}}\text{, or 13.6 } LPM$$

Figure 15:
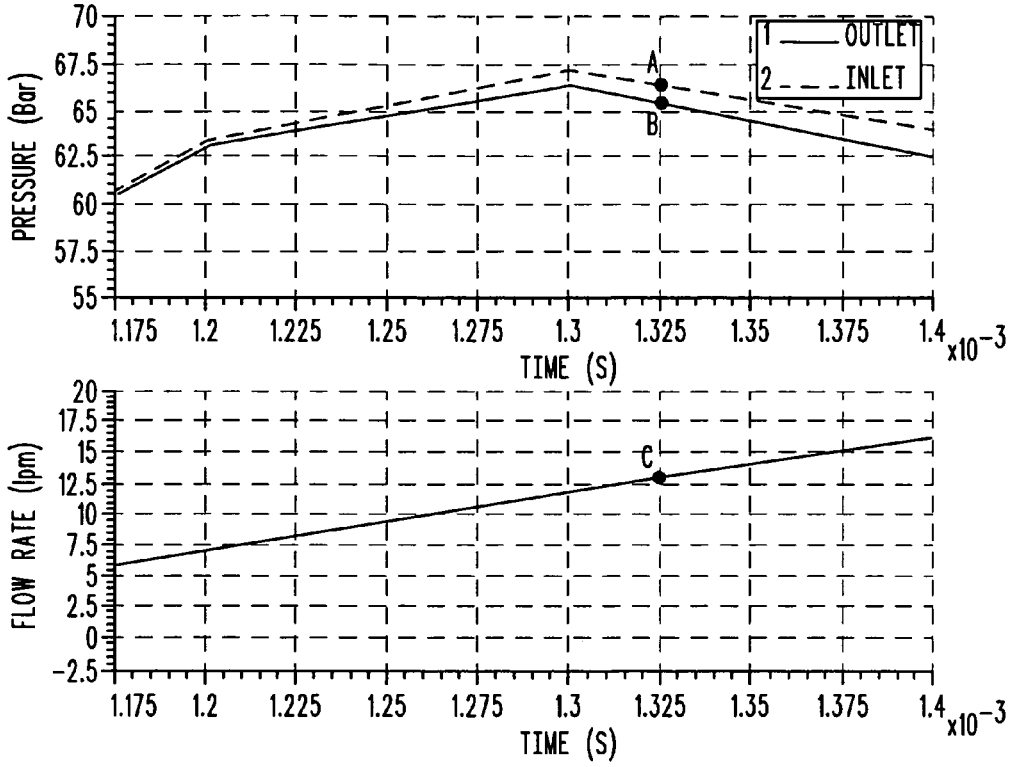
FIG. 15 shows a graphical representation of valve pressure-flow model validation data.

This calculation was done as a check at an arbitrary point of the valve opening shown in FIG. 15, and supports the results. In the simulation, a flow rate of nearly 13.0 LPM was indicated through the valve at the same moment (point 'C' in FIG. 15). This is higher than the 12 LPM supply flow rate, so also indicates some system decompression is causing a higher instantaneous flow rate through the valve. Further, the pressure peak at 1.3 ms coincides with shown transition from compression to decompression, as evidenced by the flow rate first being below the supply flow rate of 12 LPM and then above 12 LPM at this point in time. This provides further correlation with what is expected.

Figure 16:
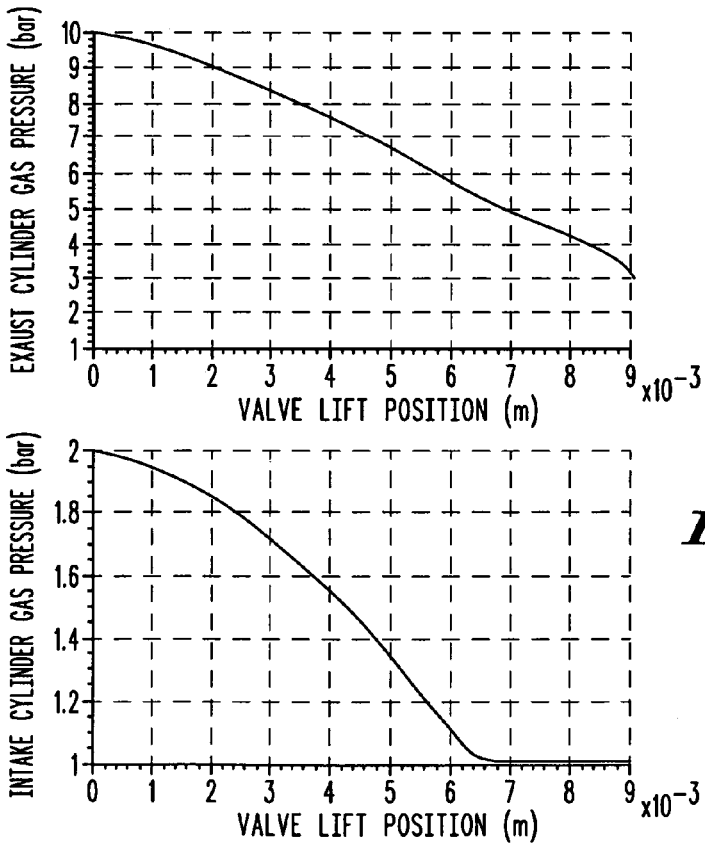
FIG. 16 shows a graphical representation of the simulation cylinder gas pressures.

Modeling results of the present invention include piston diameter optimization, valve lift profiles, gas pressure effects, oil-temperature effects, a power consumption comparison, and initial evaluation of some of the additional design concepts considered. These results are separated into intake valve and exhaust valve performance, because of the significantly different conditions and hence different piston size of each. The typical cylinder gas pressure acting on the valve is modeled exactly as the engine would be, bleeding off as the valve opens. Gas pressure bleedoff is shown in FIG. 16 versus valve position for a typical simulation.

Unless specified otherwise (such as for the temperature effects), results use 'normal' fluid properties as shown in Table 2. Most of these results are intended to determine feasibility of the system concept as high engine speeds, so are shown under those conditions (5000 RPM). Primary results are listed in Table 6, with the assumption of single intake and exhaust valves per cylinder. Note that the snubber effects for seating-velocity control are not evident except in simulation results for seating velocity (below).

TABLE 6

Estimated System Performance Capabilities

| Actuator | 10%–90% lift time (ms) | 4-Cyl. Max. speed capability | 6-Cyl. Max. speed capability | Seating velocity |
|---|---|---|---|---|
| Intake valves | 1.1 | >5000 RPM | >5000 RPM | <0.3 m/s |
| Exhaust valves | 2.15 | >5000 RPM | 5000 RPM | <0.3 m/s |

Intake valve actuation is distinctly different from exhaust valve actuation in that there is lower residual cylinder gas pressure (2 bar), and it is desired that intake valves have variable valve lift capabilities.

With the system of the present invention, in which pressure rises to move the load, oil compression occurs simultaneously and creates complex dynamics. This makes the selection of an optimum hydraulic piston size through static calculations difficult. Since all results depend on this piston diameter, an approximate size was selected based on static calculations using $$P_h = \frac{a_{gv} m_{gv} + F_{ext} + F_f}{A_{hp}}.$$

and a range of sizes nearby was compared in simulations to find an optimum size. The size selected here only represents an optimum for the specifications and known considerations.

Figure 17:
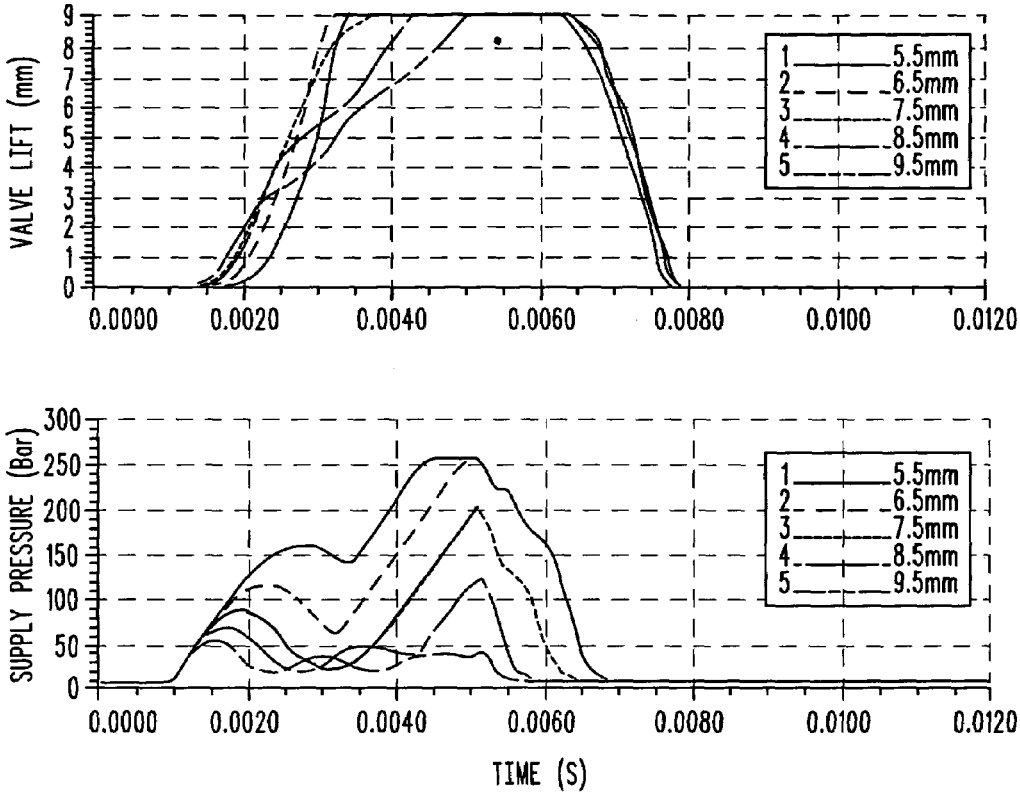
FIG. 17 shows a graphical representation of an intake valve piston diameter comparison.

FIG. 17 shows a comparison of lift profiles and also system supply pressure for the range of considered piston sizes. It is noted that the linear pressure rise after the valve is at full lift would not occur if the 'open' spool valve were timed to be shifted only a duration sufficient to achieve full valve lift. Excessive 'open' spool activation was applied here such that the larger pistons would receive flow an extended time for full-lift comparison with the others.

With this analysis, a piston diameter of 6.5 mm was chosen for the intake modules because of its lift speed. It was discovered that smaller pistons actually open slower, as did the larger pistons. This is explained by the higher maximum pressure and corresponding pressure rise-time required of smaller pistons. Larger pistons open first at a lower hydraulic pressure, but then attain a lower opening velocity for this supply flow rate. The hydraulic pressure required to begin opening the valve is determined primarily by the gas-pressure force on the valve and the hydraulic piston diameter.

Figure 18:
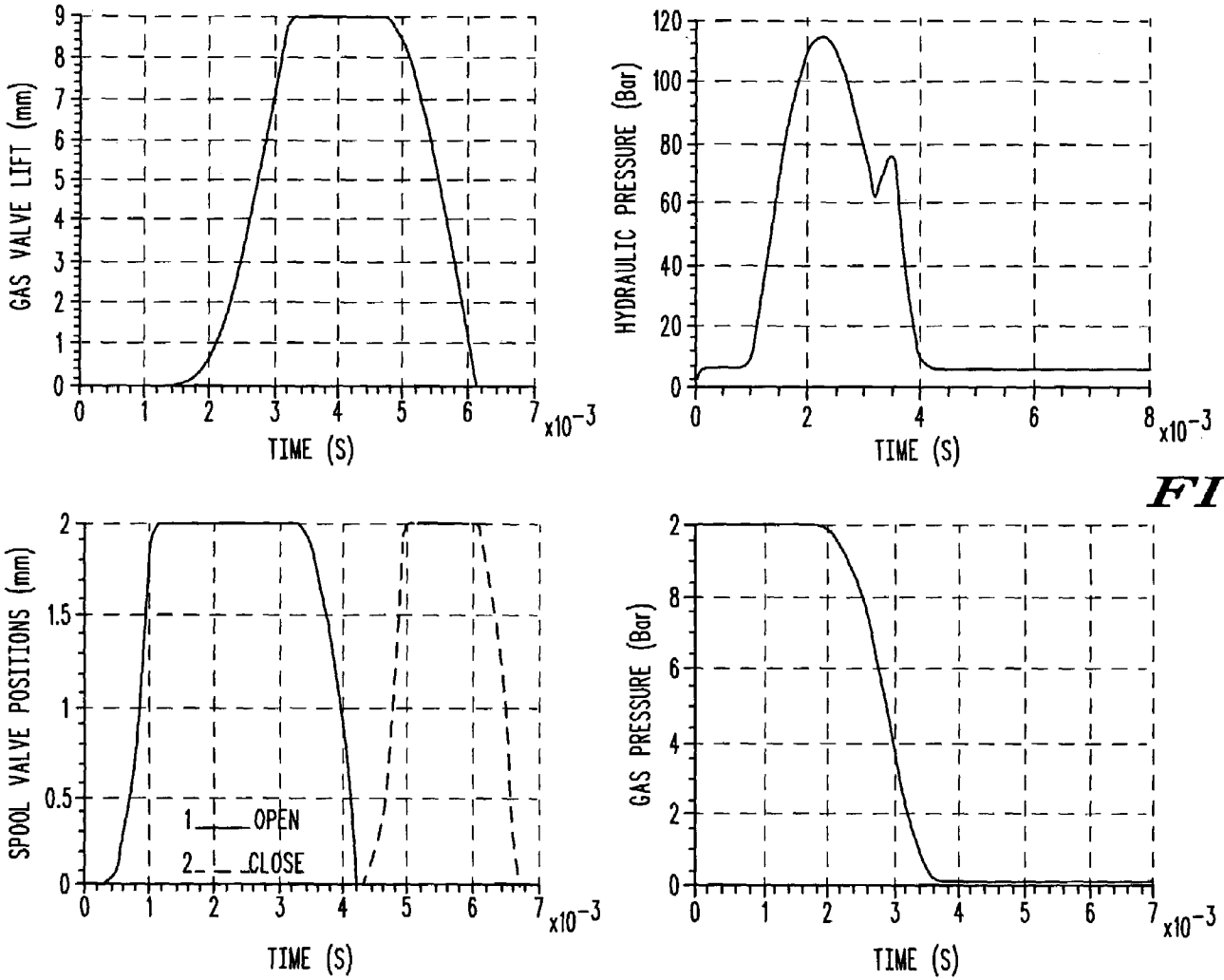
FIG. 18 shows a graphical representation of an intake valve full lift simulation.

Using the determined piston diameter of the previous results, further simulations were run to determine the minimal full event times and controllability for variable lift. A sample of results for this piston size is shown in FIG. 18 with the open and close spool positions, hydraulic supply pressure, and cylinder gas pressure during the full lift event. Some important conclusions from this are the total open-time of the Open spool valve (about 4 ms), the gas valve lift time (1.8 ms 0%–100%), and the total valve event time (4.6 ms).

The open-spool total time determines the availability of flow for other actuators on a time-scale basis—similar in concept to a multiplexer. Since individual gas valves are operated sequentially, this flow must be divided in time between the four or six intake valves depending on engine type. At 5000 RPM, there is a total of 24 ms in a four-stroke cycle as shown in FIG. 5. This allows 4 ms of pump flow per intake valve for a six-cylinder engine, or 6 ms of pump flow per intake valve for a four-cylinder engine.

Total valve event time for an intake valve at 5000 RPM would be approximately 6 ms. These results indicate the capability of this system to produce total valve event times in the 4.5 ms–5 ms range. This total event time ultimately depends also on the snubber which decelerates the closing gas valve and slightly increases the total event time.

Another significant performance requirement of the intake valve actuator is to have predictable open-loop control of variable lift. Partial lift or, for example 3.0 mm, is sometimes required to improve combustion gas swirl or simply to reduce "valvetrain" power consumption when full lift is not necessary.

Figure 19:
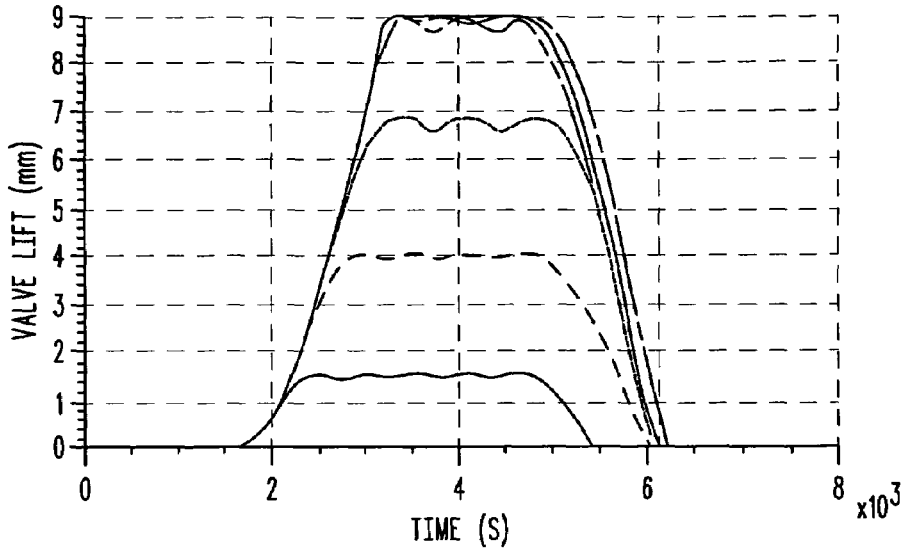
FIG. 19 shows a graphical representation of intake valve variable-lift profiles.

FIG. 19 shows the results of the variable-lift simulations for six incremental 0.3 ms reductions in duration of the open-spool activation. The first three reductions did not significantly reduce lift. This means that the initial duration was too long. A correct duration could in practice be determined by a calibration lift in which the duration for full lift is determined by monitoring the system pressure. In FIG. 17 of a prior section, it can be seen that the hydraulic pressure begins to rise at a linear rate after full valve lift has occurred. This would be a recognizable signature of the full-lift event, as measured with a single pressure transducer ahead of the first actuator. With this calibration, further events could be scaled predictably as in FIG. 19.

A procedure for selection of the exhaust valve actuator piston diameter was followed similarly as for the intake valve actuator. This piston diameter was then used for further analysis of the actuator's total lift events. The dynamics of the exhaust valve are even less predictable prior to simulation because of the 10 bar residual cylinder gas pressure, which is an initial force that decays almost completely during the lift event. As with the intake valves, oil compression occurs initially; then, as the pressure drops, decompression occurs. These are all primary factors in the interesting exhaust valve actuator dynamics.

Cylinder gas pressures on the exhaust valves are a determining factor in the piston size and response. For the higher forces, larger pistons were considered than for the intake valve. Piston sizes 0.5 mm incrementally larger than 8.0 mm are compared.

Figure 20:
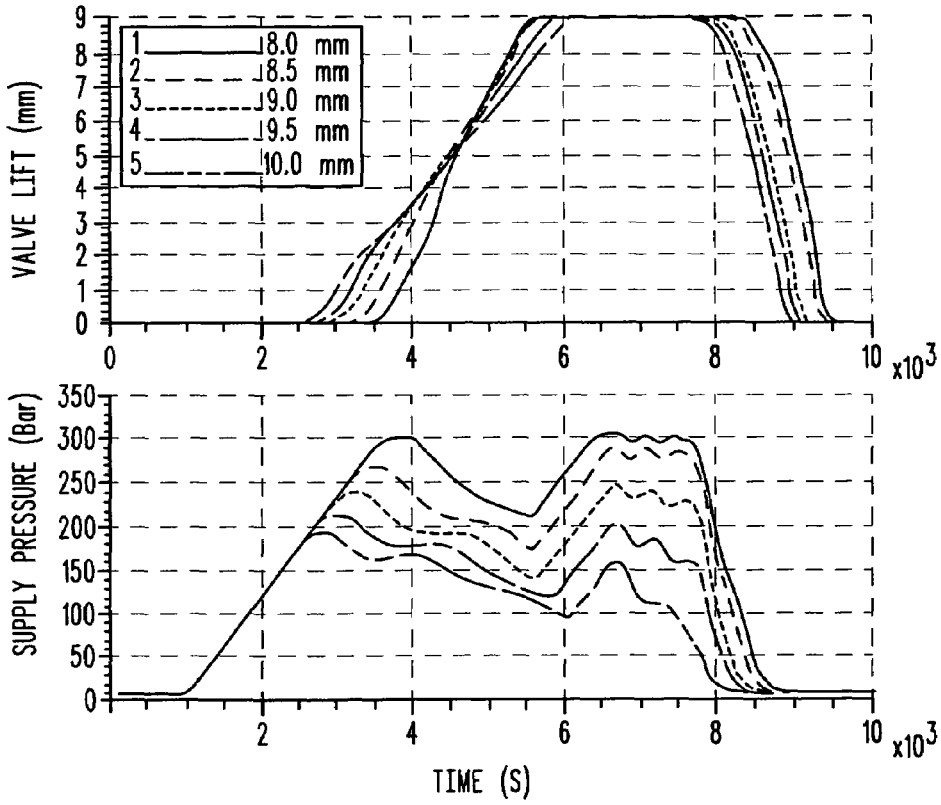
FIG. 20 shows a graphical representation of an exhaust valve piston diameter comparison.

By inspection of the results in FIG. 20, the 9.0 mm piston has a desirable combination of beginning to move the valve with less delay and accelerating to a fast opening. The 8.0 mm piston opens slightly faster, but hesitates more initially as the system pressure builds to 300 bar. At the other extreme, the 10.0 mm piston begins to move sooner (at about 190 bar) but does not travel at a sufficiently high speed.

As with the intake valve lift data, note that the supply pressure build at a linear rate after the piston is at full lift. This indicates excessive spool-open time and would be eliminated in practice with calibrated actuation times.

Analysis of the system dynamic performance with a 9 mm piston and specified exhaust valve conditions of 10 bar cylinder pressure is discussed here. Exhaust valve lift is not required to be variable, although it could possibly be varied with this actuator if desired to reduce the system power consumption in low-speed conditions. Simulations were done only for full-lift to evaluate capabilities at high engine speed. Typical results are shown in FIG. 21 under the specified conditions, showing that target 2.5 ms valve lift trajectories can be achieved.

In contrast to the intake valve actuator, the exhaust valve actuator requires a higher hydraulic pressure, and therefore, additional time delay for the hydraulic pressure to reach the required level to begin opening the valve. This is primarily because of the gas-pressure force on the valve resulting from residual combustion gas pressure.

Figure 21:
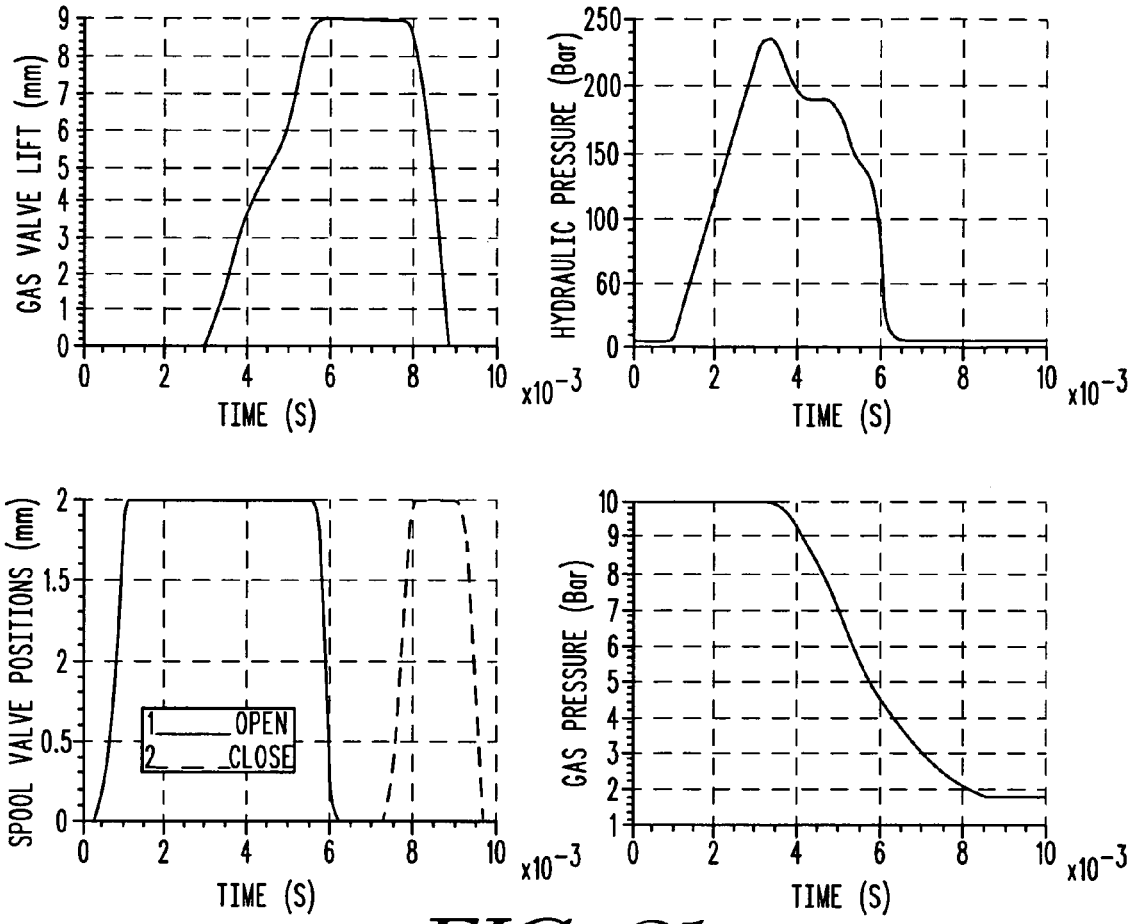
FIG. 21 shows a graphical representation of an exhaust valve full-lift simulation.

By inspection of FIG. 21, the pressure rise-time between full open-spool activation and the valve-lift event is approximately 2 ms. This time would be compensated for in a system controller to obtain proper valve timing. This increases the overall input flow time, however, which determines when flow can be utilized for other actuators (similar in concept to multiplexer operation). Based on these results (5 ms of flow for full-lift), this system could operate a 4-cylinder engine at 5000 RPM but a 6-cylinder only up to about 4000 RPM with the listed specifications and flow rates. For high-speed capabilities, possibilities exist to operate the system in a high-pressure mode only at high engine speeds (as described above in regards to FIG. 39).

Figure 22:
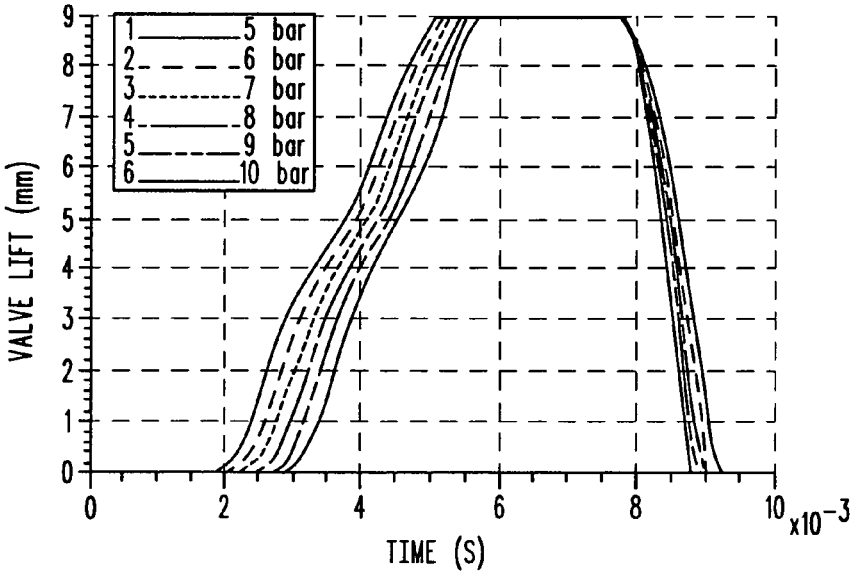
FIG. 22 shows a graphical representation of exhaust valve lift versus gas pressure.

To determine variations of valve lift as a result of varying cylinder gas pressures, lift profiles were plotted at various pressures from 5 bar to 10 bar. This is shown in FIG. 22. Cylinder gas pressure variations did not affect the lift speed and general profile significantly, although at lower gas pressures the valve took less time to build hydraulic pressure and therefore began opening sooner. Precise controllability of valve timing would, therefore, depend on estimation of cylinder gas pressure prior to a lift event. If gas pressures were fairly predictable or consistent this would not be a problem. Alternatively, gas pressures could be measured for optimum valve control purposes.

Figure 23:
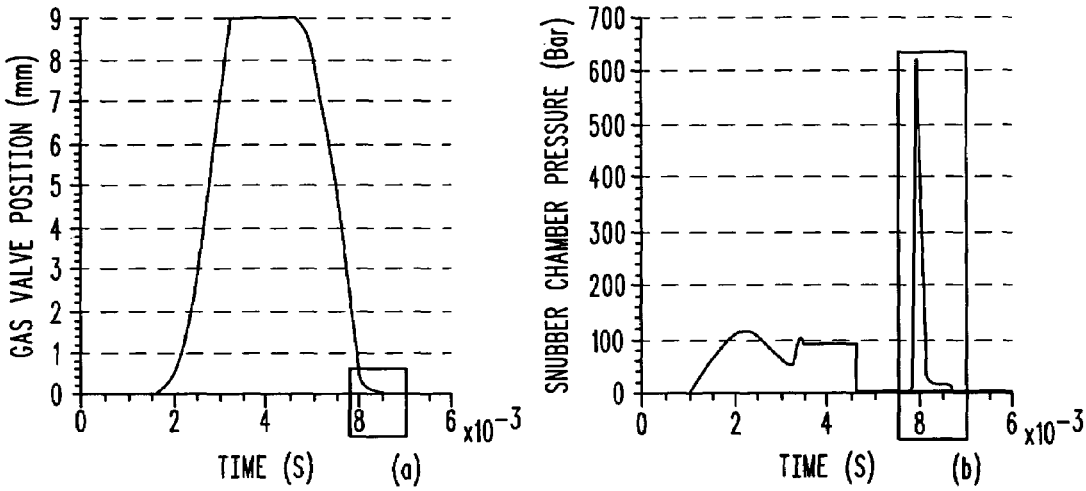
FIG. 23 shows a graphical representation of the snubber region of the valve motion event.
Figure 24:
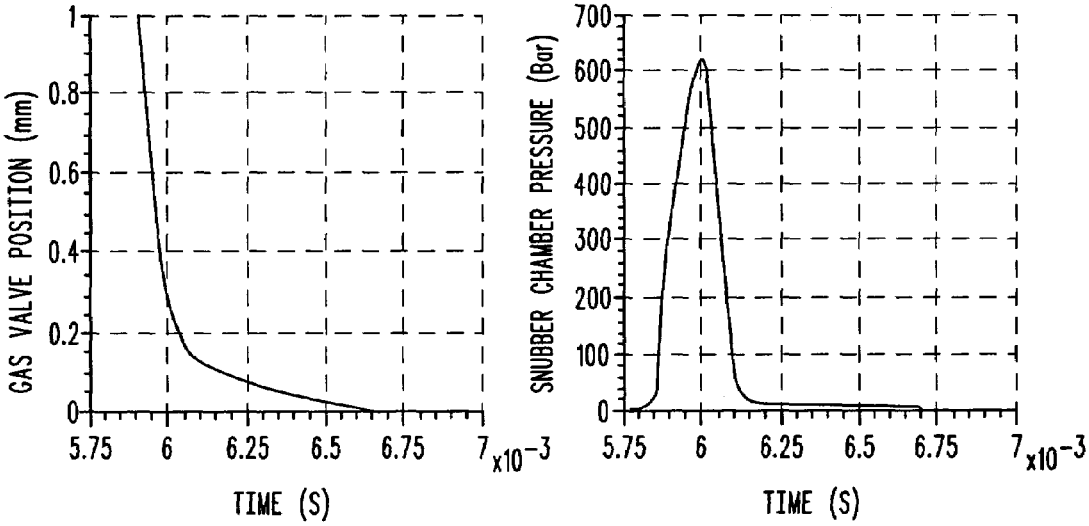
FIG. 24 shows a graphical representation of valve position and snubber chamber pressure during seating.

Results of the valve seating velocity modeling confirmed the viability of a fixed snubber design for this application and allowed design refinement. Target performances of 0.1–0.3 m/s were found to be achievable. Results included will be only partial plots of the valve event, to focus on the dynamics of the deceleration event. Valve position, velocity, and snubber-chamber pressure plots included here are approximately only the regions illustrated as boxes (a) and (b) of FIG. 23. Oil temperature had a significant bearing on the performance due to the viscosity dependence of snubber-orifice flows. FIG. 24 adjusts the graphs to show the boxed regions (a) and (b) of FIG. 23, where more specific valve position and snubber-chamber pressure buildup can be seen.

By design, the snubber engagement begins when the valve is 1.25 mm from the seat. By progressively restricting the flow outlet, it causes pressure to rise and create a decelerating force on the valve as shown in FIG. 24. These are final results after simulations were used to determine an optimum design for this particular actuator. These graphs show the approximate deceleration range and what pressures could be expected in the snubber chamber. It is noted that this pressure would not be reflected in the system pressure, only in piston chamber and inlet fluid passageway back to the check-valve. The resulting force would also need to be considered in valve component design, as it is a much more sudden deceleration than a cam would provide. The rapid deceleration is desirable from the standpoint of fast valve closing.

Figure 25:
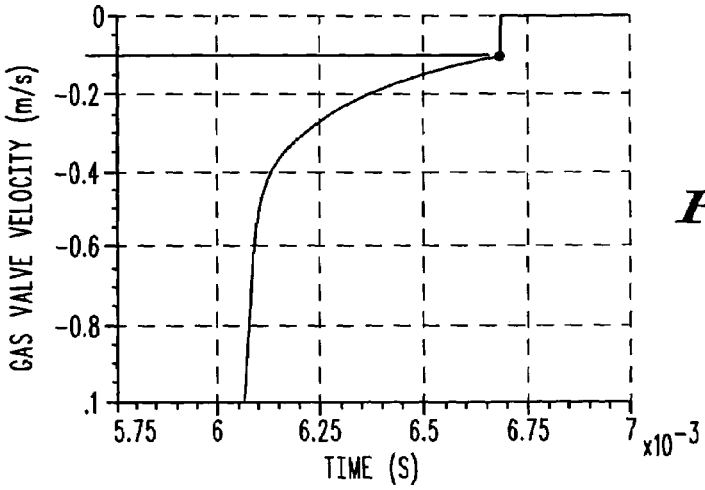
FIG. 25 shows a graphical representation of seating velocity at operating temperature.

The ultimate performance criteria for the snubber effectiveness, however, is actual seating velocity. This is shown in FIG. 25, time-scaled identically to FIG. 24. Note that negative velocity numbers are shown, which only means the gas valve is closing (positive velocity is in the opening direction).

An additional objective of the design was to have a rapid deceleration without bounce. The velocity curve of this design seems to be a desirable tradeoff of low seating velocity but maintaining a fast valve closing. The seating velocity at operating condition in this case was 0.1 m/s, indicated by the sketched horizontal line and dot of FIG. 25. The software used merely connects this final velocity with the horizontal axis when graphing the data to make a continuous curve.

A design challenge of the snubber was to meet performance specifications not only at this operating temperature but over the entire temperature range. Oil temperature has a large effect on viscosity and therefore, the flow rate through the orificing snubber slots. Iterations of designs and simulations resulted in the estimated seating velocities shown in FIG. 26 versus oil temperature.

Figure 26:
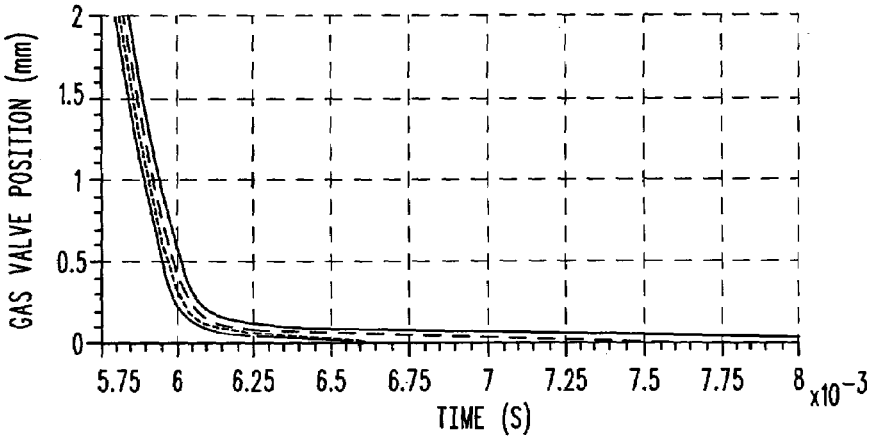
FIG. 26 shows a graphical representation of valve seating velocity versus oil temperature.
Figure 26:
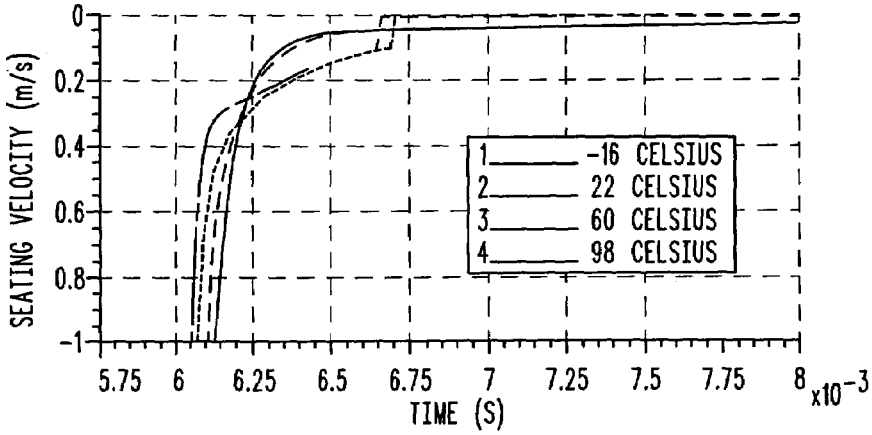

Valve seating velocities determined as in FIG. 26 show the high dependence on oil temperature. With this design, performance is within the specification and the valve seats quickly. However, at the lowest temperatures, high oil viscosity causes the valve to close at a rate so slow it delays valve closing up to 1.5 ms. In all cases the seating velocity is within the specified seating velocity, but the low-temperature condition would need careful consideration. Options may be to have early valve closing at low temperature to compensate, or a large orifice area which would allow faster closing speeds at all temperatures but still within specifications.

Hydraulic fluid properties such as viscosity, density and bulk modulus (compressibility) each are highly dependent on oil temperature. This causes actuator performance to be oil-temperature dependent. The net effect depends on the type of valving and fluid tubing used however. For comparison purposes, the EHOCVA system of the present invention was simulated along with a typical metering system using an ideal constant-pressure source.

Figure 27:
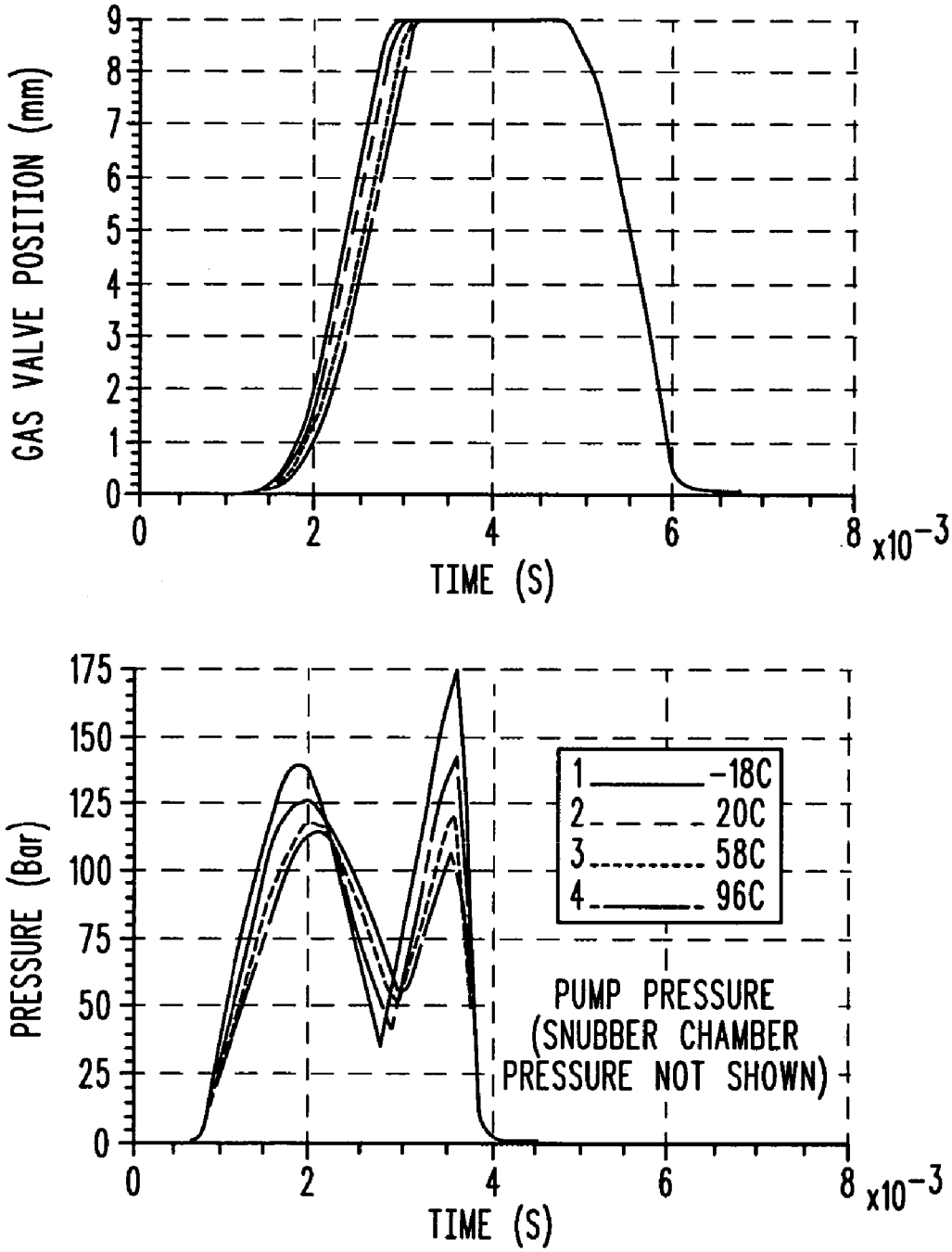
FIG. 27 shows a graphical representation of EHOCVA system lift and pressure versus fluid temperature.

Initially, when considering the system design, it was assumed that the performance would have excellent tolerance to viscosity variations because viscosity changes would be primarily reflected in the pump pressure and not the pump flow. However, it was found that higher viscosities decrease pump leakage and would tend to maintain or increase fluid flow-rate slightly. Although pump leakage is not considered in the present invention, the net effect of changing fluid viscosity and bulk modulus due to temperature fluctuation is considered. Generally, at lower temperatures, oil viscosity and bulk modulus both increase. In addition, both oil properties have a pressure dependence, creating an unobvious effect without simulation such as shown in FIG. 27.

These results confirm that low temperatures would not affect the performance significantly, or at least as much as a metering system would be affected. In fact, the lift response at cold temperature (solid line shown at −18 C.) is faster at cold temperatures, due to the higher bulk modulus. The gas-valve 'flight time' is relatively constant for the given fluid flow-rate. Conversely, a metering system would have a maximum valve lift rate that may not be easily changed.

Note in this same figure that fluid supply pressure is higher at lower temperatures, due to the higher line friction losses and higher pressure drop in system orifices. In other words, the pressure of the fixed-displacement pump rises to whatever level is necessary to maintain flow rate-unless limited by a relief valve or available input torque. Also note that the second pressure rise and peak is only due to excessive spool-valve activation, which would in practice be calibrated out by the control system.

Figure 28:
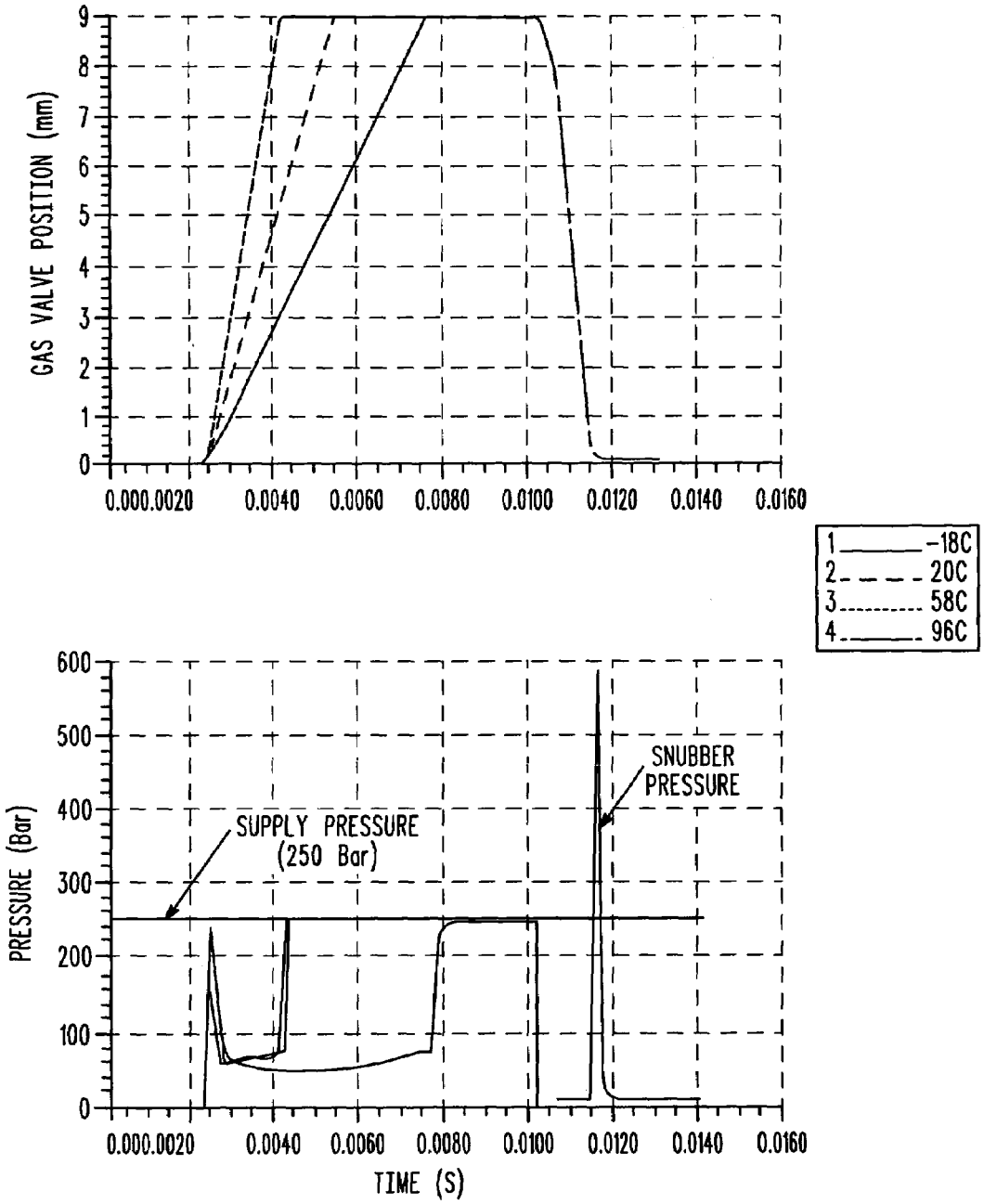
FIG. 28 shows a graphical representation of metering system lift and pressure versus fluid temperature.

For comparison purposes, a model representing a typical metering system was developed. It includes an 'ideal' constant-pressure source (flow rate is always sufficient to maintain pressure when the valve is activated), a small metering valve which allows the required valve lift speed, and identical gas-valve components as the prior system. Such a system typically uses a metering valve with a maximum orificing area which determines the flow rate depending on pressure and oil viscosity. FIG. 28 shows a plot of resulting valve lift profiles that were simulated over the temperature range of −18 C. to 96 C.

Most notable about the metering system temperature dependence is the lift speed at low temperature. Low oil viscosity reduces flow through a fixed orifice at a fixed pressure as a result of a lower flow coefficient and possibly laminar flow. Consequently, the time for full valve lift nearly tripled. This could be compensated for if the system had proportional spool valves. Something less than full spool displacement would be used at operating temperatures and a larger displacement used at low temperatures. Alternatively, a higher system pressure could be set under low temperature conditions to maintain valve lift profile. In any case, current working systems prove there are effective ways of adapting the systems to low temperature conditions-at a cost.

Figure 29:
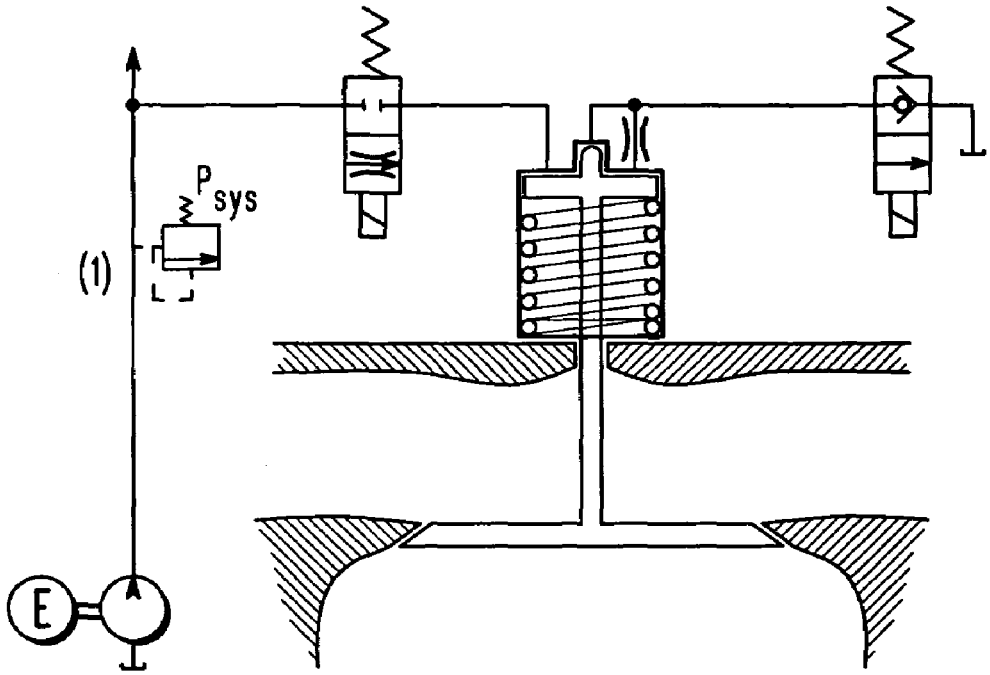
FIG. 29 shows schematic diagrams of compared systems.
Figure 29:
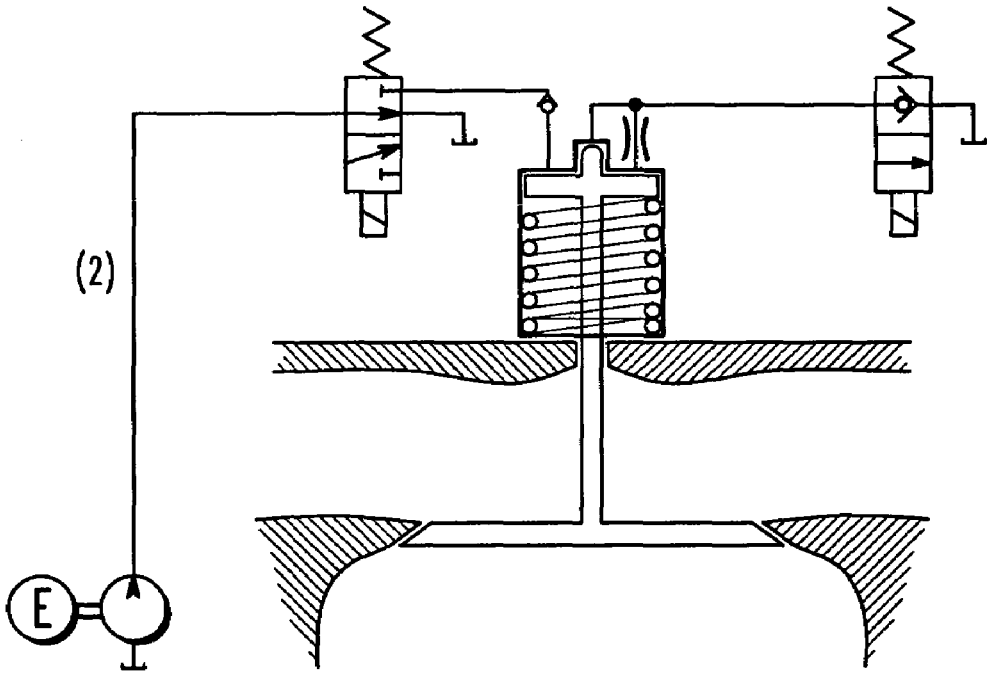

It was recognized that when comparing the power requirements of systems, a given actuator and load (in this case the hydraulic piston, valve, and valve spring assembly) will require a fixed amount of power to move at a defined rate and distance. However, the power consumed by the hydraulic system as a whole varies drastically depending on design. One system may waste a significant amount of power by generating flow at pressure that is not utilized at times in the duty cycle. This power is converted to heat, mainly evident in the oil, as the oil is pushed over a type of relief valve. This is where the systems being compared differ. For discussion purposes, a sketch of functionally comparable systems is shown in FIG. 29.

In this illustration, system (1) is an example of an equivalent constant-pressure system, where the pump is held at a constant pressure by the adjacent relief valve. When flow is not being used by any actuator (all of which are in parallel with the relief valve), flow is pushed over the relief valve at high pressure resulting in wasted power. As previously discussed, the open-center system of the present invention (labeled '2' in FIG. 29) allows for pump flow to go freely at low pressure when an actuator is not being used (assuming line losses and valve losses are relatively insignificant).

For a quantitative power consumption comparison, identical actuators were assumed for both system types. This is a legitimate comparison because the actuator sizes would need to be approximately equal in both types of system for a given engine's valve size, lift, and required opening speed. The supply flow rates are assumed to be equal. In both systems, a separate supply is assumed for intake valves and exhaust valves. This is assumed for legitimate comparison because an efficient constant-pressure system would probably use a higher pressure only for exhaust valves due to the higher cylinder gas pressure, which affect the required opening power. Supply pressure assumed for each of the constant pressure system circuits is based on the maximum non-spike pressure observing during simulations of the equivalent open-center systems for this size actuator piston. With a larger piston, lower pressures would be possible, but higher flows would be required to maintain actuation speed. Therefore, the power shown should be quite close to a minimum for each system in both cases (for the gas valve specifications used in the simulation). Another assumption in this comparison is that cylinder gas pressures are initially 2 bar on the intake valve, and 10 bar on the exhaust valve. For this analysis, the power consumption of associated solenoid in the system was not included.

TABLE 7

| | Assumptions for Power Comparison | | | |
|---|---|---|---|---|
| | Piston diameter | Supply flow rate | Supply pressure: intake valve circuit | Supply pressure: exhaust valve circuit |
| System (1): constant pressure | 8.5 mm | 10 LPM | 125 bar | 250 bar |
| System (2): EHOCVA | 8.5 mm | 10 LPM | Determined by cylinder gas pressure including circuit losses of 2.2 bar | Determined by cylinder gas pressure including circuit losses of 2.2 bar |

Under the assumptions of Table 7 for this comparison, the pressure-flow product of each circuit for both systems was integrated and plotted versus time. The vertical axis would be integrated power (energy), which divided by the elapsed time is power. Since actuator power draw and fuel efficiency factors are most important at highway cruising speeds, the comparison is made at 2000 RPM. At this speed, intake valves and exhaust valves of a 6-cylinder engine would each operate at 10 ms intervals. This is determined referring in FIG. 5, and noting that a 4-stroke engine cycle is 720 degrees of crank rotation. For a 4-cylinder engine, the comparison can be made by noting that the time between intake or exhaust valve events would be 15 ms. In other words, the beginning of one intake valve event would be 15 ms after the beginning of the prior intake valve event at this engine speed. By looking at the integrated power for a single valve event (right up to the beginning of the next valve event) and dividing by the elapsed time, average power can be calculated. The power calculations below were performed in this manner, as shown in FIG. 30.

Figure 30:
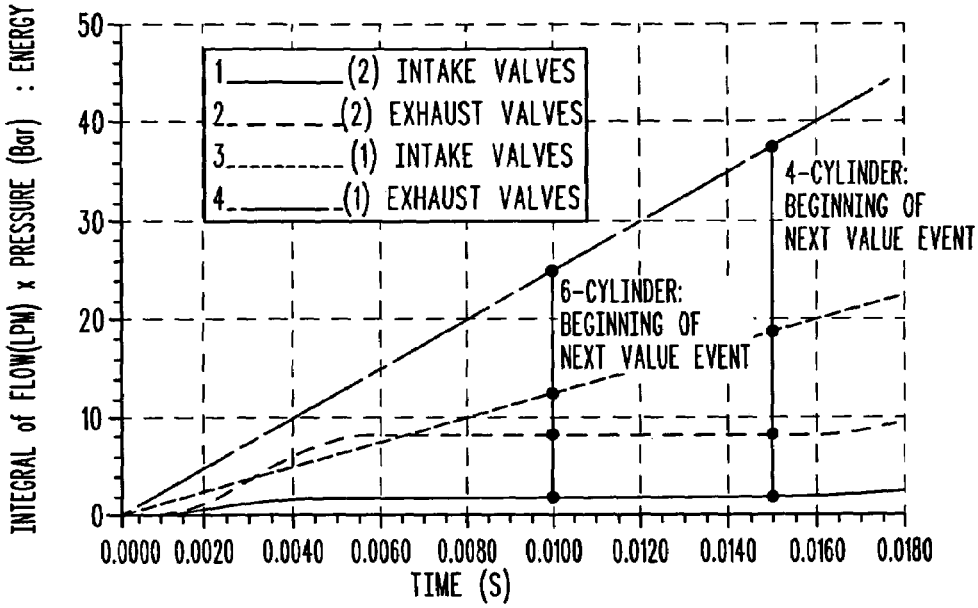
FIG. 30 shows a graphical representation of a simulation power consumption comparison.

The notable conclusion of FIG. 30 is that there is little energy used by system (2) between valve events. Average power can be found by energy/elapsed time, in this case $$\frac{\int (Q[LPM] * P[\text{bar}])}{600 * \Delta t[\text{s}]},$$

where Q is supply flow rate, P pressure, Δt the elapsed time in seconds, and the resulting power units are kW. Total power consumption for each case is shown in Table 8.

TABLE 8

Power Comparison Results

| System | Input power for intake valves [kW] | Input power for exhaust valves [kW] | Total input power [kW] |
|---|---|---|---|
| (1): 4-cyl. @ 2000 RPM | 2.08 | 4.16 | 6.24 |
| (1): 6-cyl. @ 2000 RPM | 2.08 | 4.16 | 6.24 |
| (2): 4-cyl. @ 2000 RPM | 0.19 | 0.92 | 1.11 |
| (2): 6-cyl. @ 2000 RPM | 0.27 | 1.36 | 1.63 |
| Phillips Ind. Electronics/L. Gould (pneumatic) 4-cylinder @ 1800 RPM | | — | 2.5 |
| Lucas Automotive EH, 4–7% of output, Ex: 120 kW engine | | — | 4.8–8.4 (est. 10% is electrical) |
| Conventional valvetrain 4-cylinder | | — | 0.14 |
| Renault EM 4-cylinder | — | — | 0.3 (idling)–2.0 (Max) |

The power advantage of system (2) would be significant considering this power is directly parasitic on engine output. The accuracy of this comparison depends on the implementation of the systems being compared, but the potential is significant enough to warrant serious consideration of the present invention. At higher engine speeds, the comparative advantage is less significant because system (1) power would be utilized. At low engine speeds, power consumption of either system could be improved by reducing hydraulic supply flow rate under the assumption slower valve speeds could be tolerated. As discussed below, at idle speed the hydraulic pump input power is estimated to be as low as 260 Watts. Power consumption of system (2) would also decrease when partial valve lift was used. In the constant-pressure system, partial valve lift would not result in reduced actuator system power consumption without a coordinated reduction in supply flow rate.

The electrical power input for activation of such systems has been estimated to be 10% of the total system actuation power. In this estimate, the total power consumption of hydraulic actuation would be 4–7% of engine output, or 4.8 W–8.4 kW for a 120 kW engine. Therefore, the estimate of electrical load would be 480 W–840 W. This electrical load estimate could be reasonably expected to remain constant independent of system type, but does depend whether direct spool activation, piezoelectric stacks, or pilot activation (for example), is used.

Simulation results shown previously each assume a 10 LPM flow source, with the goal of determining performance in the limiting case (5000 RPM engine speed). Although this operating speed is key to feasibility, the performance at lower engine speeds with the flow being proportional to engine speed is also important to consider since the system could likely be powered by a mechanically-driven fixed-displacement pump. For this purpose, Table 9 indicates flows and pump speeds resulting from proportional engine speeds less than 5000 RPM.

TABLE 9

Engine-driven Pump Speed and Flow Rates

| | Drive ratio | | | | | | | |
|---|---|---|---|---|---|---|---|---|
| | 1:1 | 1:1 | 2:1 | 2:1 | 3:1 | 3:1 | 4:1 | 4:1 |
| Engine speed (RPM) | 5000 | 800 | 5000 | 800 | 5000 | 800 | 5000 | 800 |
| Pump speed (RPM) | 5000 | 800 | 2500 | 400 | 1667 | 267 | 1250 | 200 |
| Engine flow (LPM) | 10 | 1.6 | 10 | 1.6 | 10 | 1.6 | 10 | 1.6 |

Figure 31:
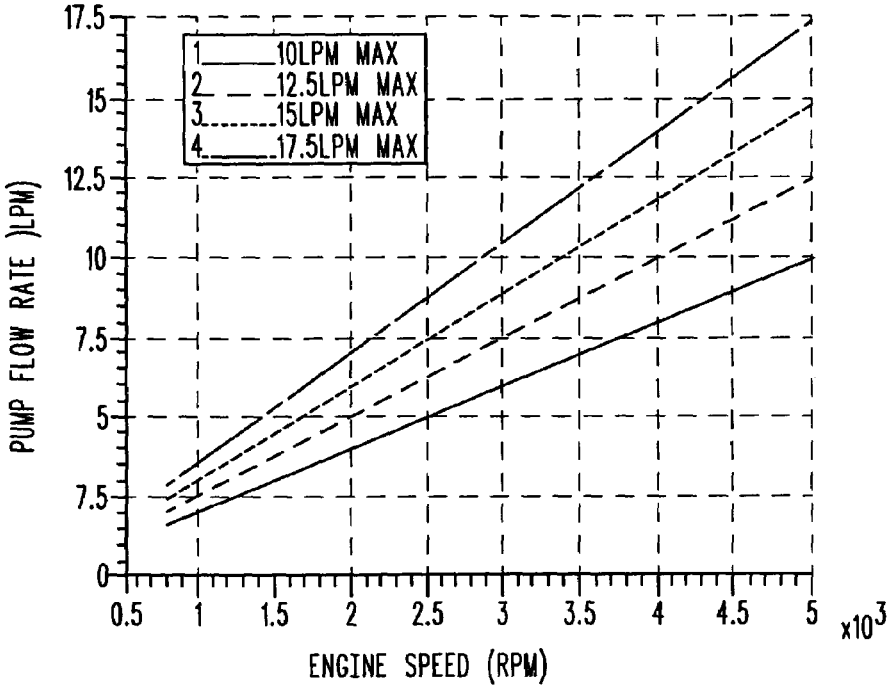
FIG. 31 shows a graphical representation of pump flow versus engine speed (for various pump sizes)

The various drive ratios shown in this table are used to indicate the pump-speed operating ranges which would result by reduction drive, which affects the pump size used. Note that the resulting pump flow requirements are fixed. The tradeoffs for the pump speed operating range involve durability and efficiency of the pump. Pumps generally have a lower volumetric efficiency at lower operating speeds due to leakage. The resulting linearly proportional flow rate at various engine speeds for the assumed pump size and several larger sizes is shown in FIG. 31, which provides an idea what the effect of slightly larger engine-driven pumps would be over the RPM range.

Since extensive simulation results were previously done at 5000 RPM, only simulation results at 800 RPM (considered a reasonable engine idle speed) will be shown in the results below and discussed as an opposite extreme operating condition. From FIG. 5 it can be determined that at 800 RPM, the total valve event time should be approximately 37 ms (two and a half times the valve event time at 2000 RPM).

Figure 32:
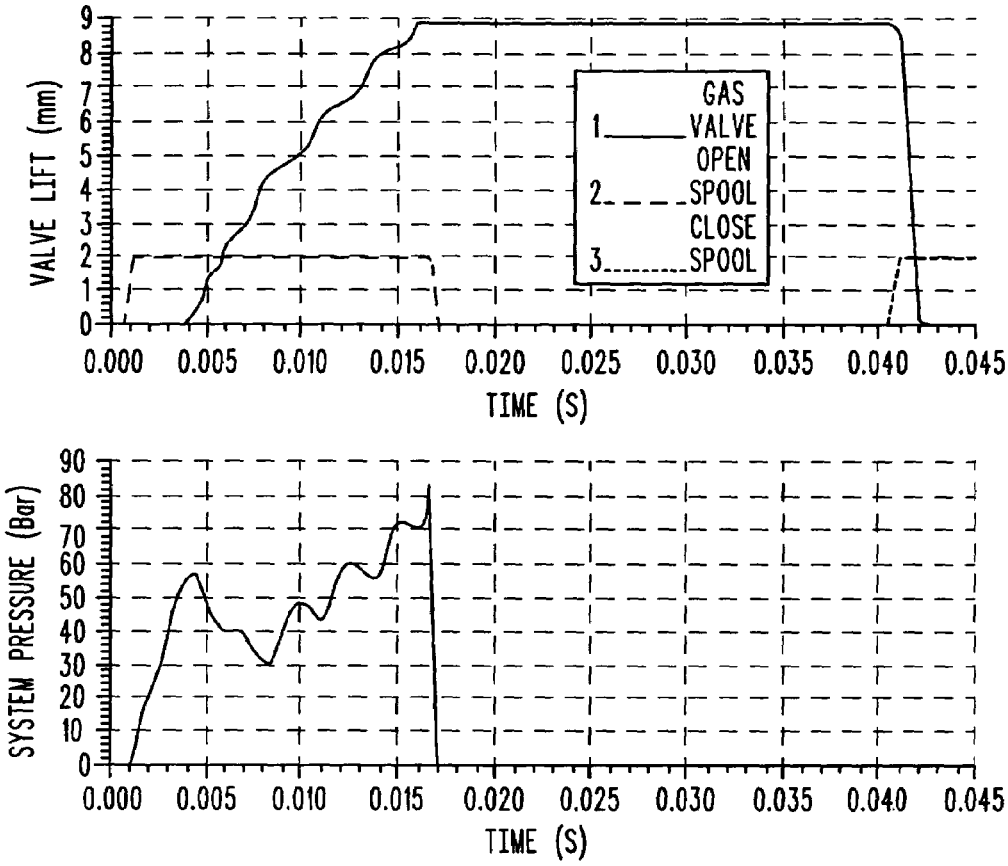
FIG. 32 shows a graphical representation of engine-speed dependent flow lift profile (at 800 rpm)

From FIG. 32, showing this plot of valve lift at 800 RPM, the approximate required spool valve shift opening times are estimated and signature system pressure profile at this speed is predicted. The implementation question would be whether this lift profile is sufficiently fast opening, at this engine speed. It appears to be an improvement over standard cam lift profiles (more square) and would allow accurate lift to be achieved due to the relatively slow lift rate.

Other options for this system as noted before would be to have an electric-motor driven pump which is entirely independent from engine speed or a smaller electric-driven pump which only provides supplemental flow to a primary engine-driven pump.

With an engine-driven pump as discussed above, the power consumption of the hydraulic system would be proportionally lower at low engine speeds such as at idling. This may be important for fuel-efficiency-in city traffic, for example. To determine what input power might be required, an analysis was done under this operating condition for a four-cylinder engine. At the considered engine speed (800

RPM), intake-valve events and exhaust-valve events would recur approximately at 37 ms intervals and this is the basis of the following power calculation. The flow rate used is 1.6 LPM, actuating a 6.5 mm intake-valve piston and 9 mm exhaust-valve piston to a lift of 9 mm. In reality, the lift would not likely need to be the full 9 mm under idling conditions, and reduced lift would reduce this estimated power consumption even further. The integrated energy graph is shown in FIG. 33.

Figure 33:
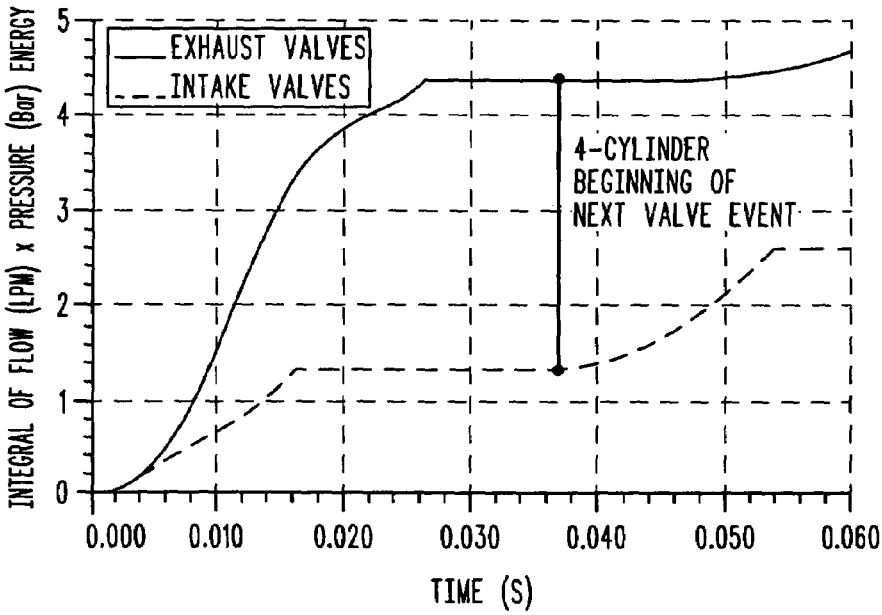
FIG. 33 shows a graphical representation of system power consumption at 800 rpm (with reduced lift rate)

Using the energy plot of FIG. 33 and $$\frac{\int (Q[LPM] * P[\text{bar}])}{600 * \Delta t[\text{s}]},$$

average power consumption for the intake valve system is found to be 0.058 kW and similarly, 0.20 kW for the exhaust valves. This indicates a total average hydraulic pump power consumption for this system at idle speed of approximately 260 Watts or less (depending on what lift rate and actual valve lift is found to be sufficient). There would additionally be an electrical activation power load, as estimated above.

Simulation of the integral regenerative piston concept of FIG. 9 was done as a preliminary evaluation of the concept. The design simulated is slightly different than shown in this figure, but the results are based on the same principle of operation. For this model, the parameters of Table 10 were used. These parameters represent a large diesel-type engine, in which the present invention may provide a cost-effective advantage for exhaust valve actuation.

TABLE 10

Integral Regenerative Piston Model Parameters

| Major actuator piston diameter | Minor actuator piston diameter | Cylinder gas pressure | Maximum valve lift | Position of lift for regeneration | Supply flow rate |
|---|---|---|---|---|---|
| 15 mm | 9.5 mm | 20 bar | 15 mm | 4.5 mm | 15 LPM |

Figure 34:
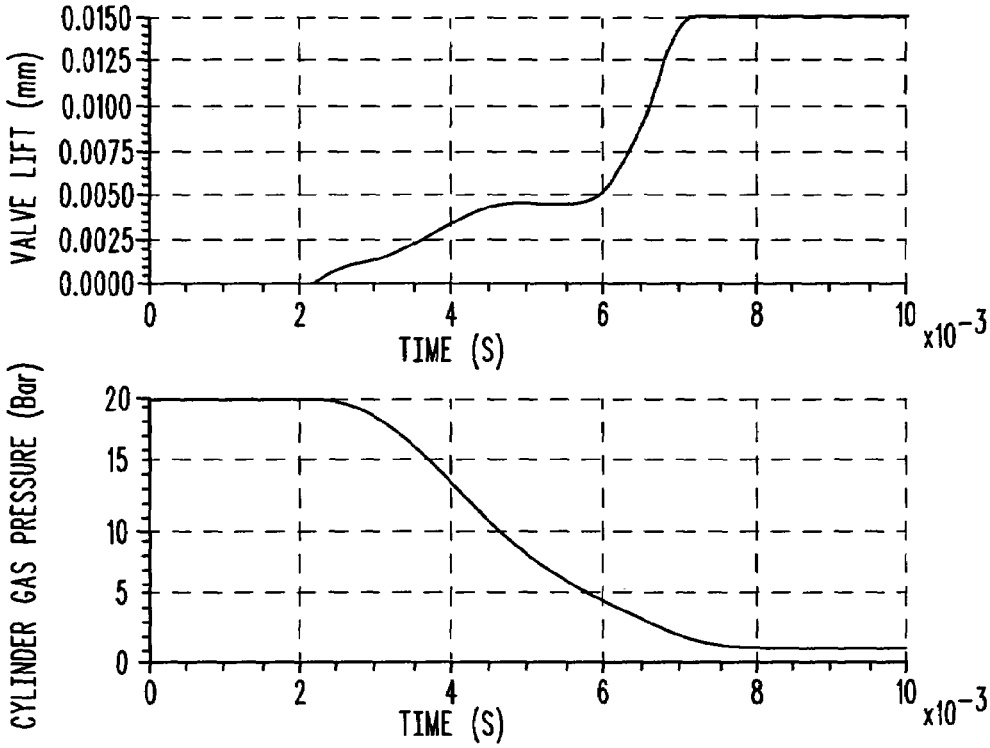
FIG. 34 shows a graphical representation of an integral regenerative piston lift profile.

Large diesel engines typically have these higher gas pressures and higher valve lifts noted in Table 10 which have counter requirements of higher force and higher speed respectively. The goal of this simulation was to show the net effect of this regenerative piston, which would initially provide a high force to open the gas valve (despite high cylinder gas pressures), and subsequently travel at a higher speed when the gas pressure has reduced and a lower force is required. The change in speed occurs when the bottom valving land of the piston stops outflow (at 4.5 mm of lift), and begins a regenerative mode. The position where this change occurs depends only on the designed location of the lands. In FIG. 34 it can be seen that the piston travels first at a lower velocity; then, after 4.5 mm of lift, it hesitates (as the system builds further hydraulic pressure), and continues at a higher speed to a total lift of 15 mm.

The net result is the valve opens much faster than otherwise, as could be extrapolated from the first lift slope, and at a lower pressure than an equivalently fast standard piston. A smaller piston would require much higher initial pressure to create the static force of opening the valve against the high cylinder pressure. Diesel engines with compression braking systems sometime open the exhaust valves against up to 35 bar gas pressure. This compares to 10 bar, typical of gasoline engines. Although this simulation was done with the EHOCVA system of the present invention, the integral regenerative piston configuration could potentially improve a general constant-pressure system by allowing a much lower hydraulic system pressure and flow rate to be used.

As a gauge of required manufacturing tolerances and dependability of performance with wear and contamination, it is beneficial to check the present invention's sensitivity to different factors. A few examples are included here.

Figure 35:
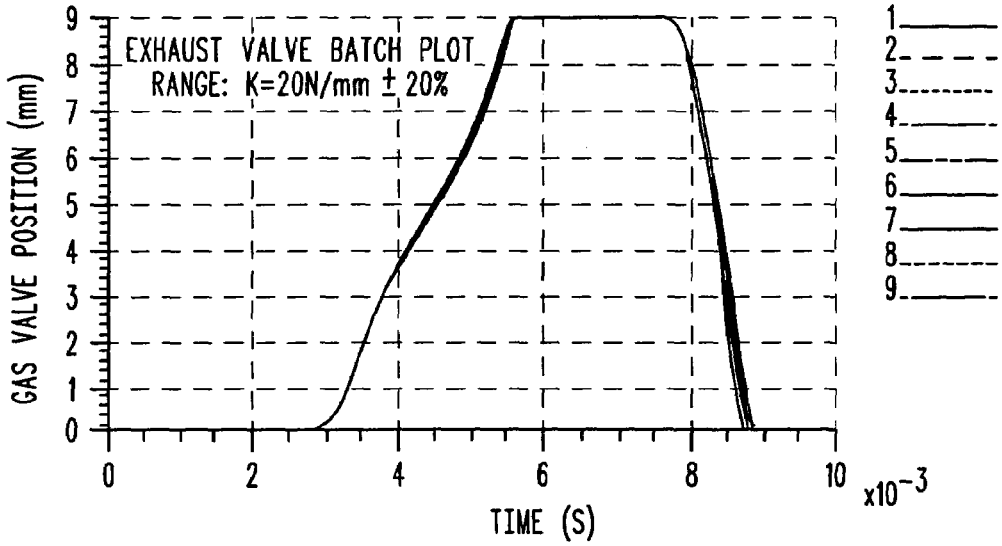
FIG. 35 shows a graphical representation of lift profile sensitivity to spring constant.

Although engine valve spring preload would be adjustable, the spring constant would not be. Spring constants would, in fact, be difficult to inspect during assembly. A simulation with a range of spring constants was done to determine whether variation would affect actuator performance significantly. The results are in FIG. 35. The spring constant variation of 20% is thought to be a realist tolerance to expect, and by inspection of these results, such a variation provides an insignificant effect on the actuator performance.

Figure 36:
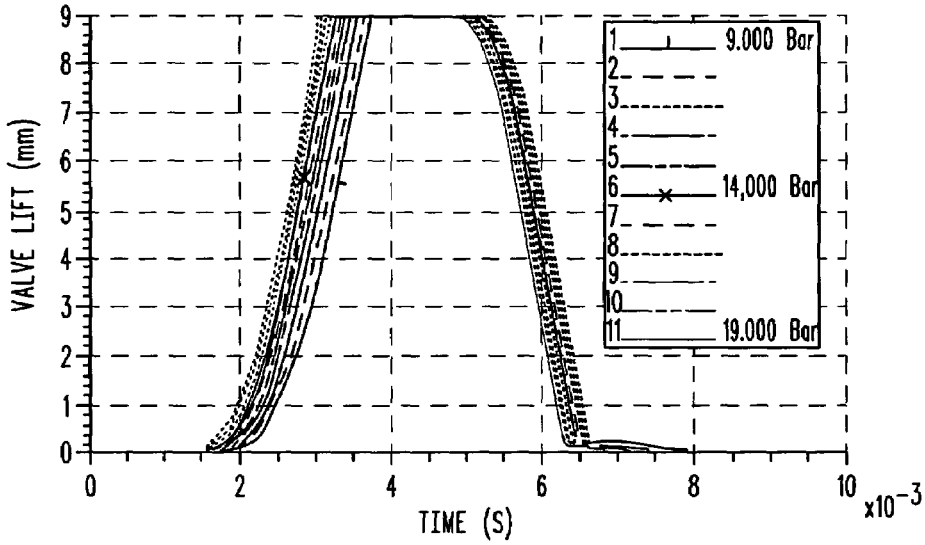
FIG. 36 shows a graphical representation of intake lift versus lumped-parameter bulk modulus.

To separate out the effect of fluid bulk modulus (β) viewed as a lumped parameter (system stiffness), batch plots showing the resulting valve behavior at various values were done, as shown in FIG. 36. In prior simulations, β was a function of pressure and temperature. In these results, it is fixed for each run. This provides prediction of actuator behavior when the apparent system bulk modulus changes from factors such as entrained air, fluid contamination, or insufficiently rigid fluid tubing. Fluid tubing that expands significantly under pressure causes the system volume to fluctuate and results in a lower apparent bulk modulus.

Because the valve dynamics differ so much, both intake and exhaust valve dependence on bulk modulus were analyzed. Intake valve dependence is shown first here in FIG. 36. Unlikely extremes of β in both directions are considered. For the intake valve, lift has an expected slower response at low bulk-modulus values but could be compensated for by control system calibrations. Also apparent is a tendency to bounce when cushion engagement begins, at the low 1 values (9,000 Bar). This is clearly a hydraulic bounce, and not a mechanical bounce, fortunately. The point is merely to illustrate potential actuator behavior in this extreme, unexpected condition.

Figure 37:
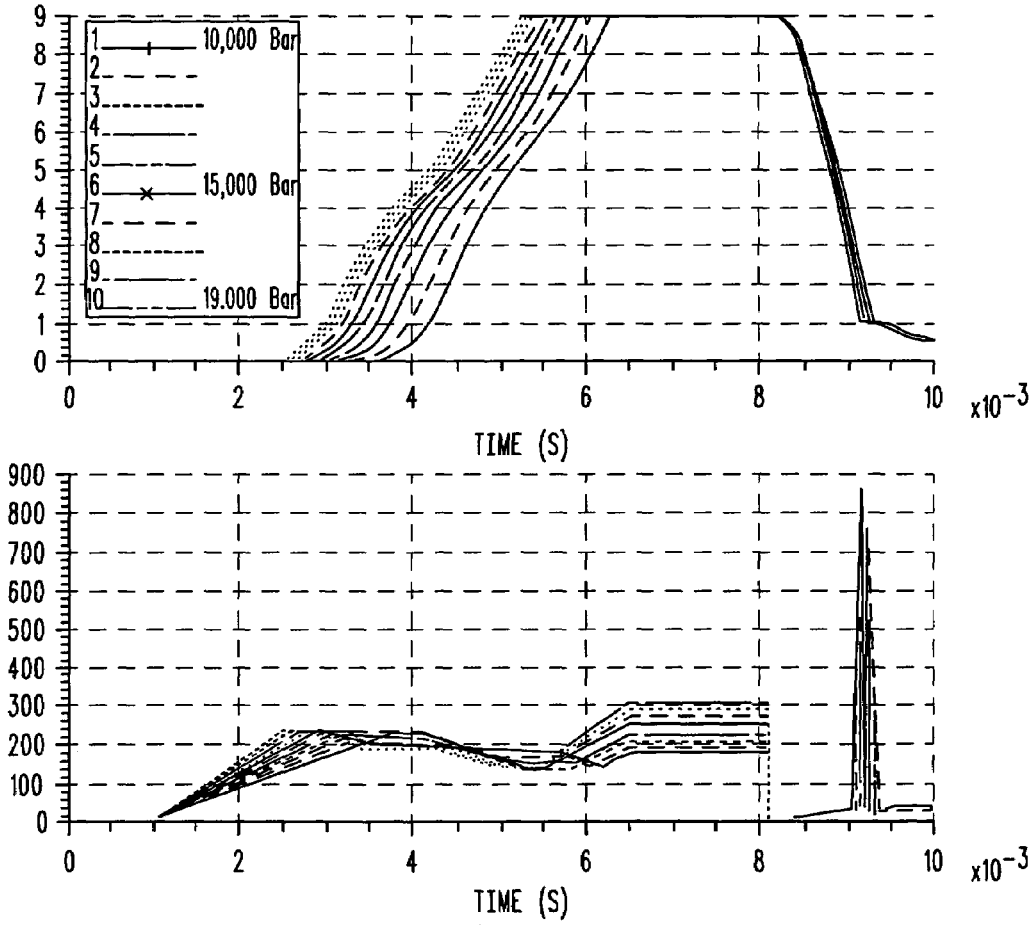
FIG. 37 shows a graphical representation of exhaust lift versus lumped-parameter bulk modulus.

Finally, the exhaust valve behavior is examined with respect to the range of system β values. Shown here in FIG. 37 is the valve lift and also piston chamber pressure. Note the snubber design used was optimized for the intake valve, and could be separately optimized to provide fast exhaust valve closing.

The inclusion of pressure plots in FIG. 37 allows comparison of pressure rise-rates and pump flow requirement on a time basis. Note that command caused the pressure to begin rising at about 1 ms, and valve motion began in the range of 3 ms–4 ms. Understanding of this operation and compensation for variables affecting it would allow accurate, predictable valve control in nearly all conditions. These plots also serve to highlight the importance of maximizing bulk modulus for this type of open-center system. All aspects of system design should particularly aim to minimize air entrainment, contamination, and any other factors affecting the effective bulk modulus. Fluid tubing should be as rigid as possible, to prevent pressure expansion and the resulting effects on system stiffness.

Figure 40:
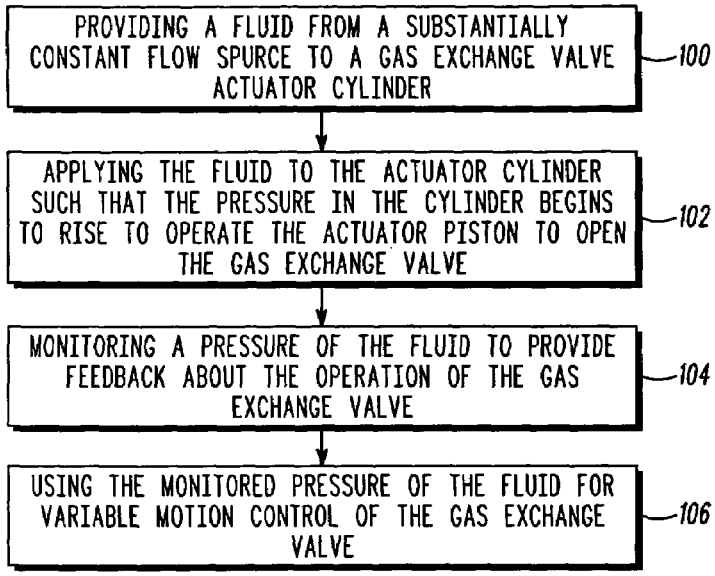
FIG. 40 is a flow chart of a method in accordance with the present invention.

The present invention, also include a method for hydraulically actuating a gas exchange valve, as shown in FIG. 40. The method includes a first step 100 of providing a fluid from a substantially constant flow source to an actuator cylinder. The actuator cylinder contains an actuator piston therein coupled to the gas exchange valve. The actuator piston is operable to slide within the actuator cylinder upon application of pressure from the fluid applied thereto for actuating the gas exchange valve.

Preferably, this step 100 includes providing an inlet device before the actuator cylinder. The inlet device has at least two operable stages, a first stage wherein low-pressure fluid is allowed to freely pass through the inlet device, and a second stage wherein the fluid is directed through the inlet device to the actuator cylinder. More preferably, a plurality of actuator cylinders is provided, each with an associated inlet device. Specifically, the inlet devices are mechanically coupled in series along the fluid supply line wherein the inlet devices operating in the first stage freely pass the fluid to the next inlet device in the fluid supply line with the last inlet device in the line passing the fluid to the reservoir.

More preferably, this step 100 includes providing an outlet device after the actuator cylinder. The outlet device has two operable stages, a first stage wherein the outlet device closes off flow from the actuator cylinder, and a second stage wherein the outlet device allows fluid from the actuator cylinder to pass therethrough. More preferably, a plurality of actuator cylinders are provided, each with an associated outlet device. Specifically, the outlet devices are mechanically coupled in parallel along the fluid supply line wherein each outlet device operating in the second stage passes fluid to the reservoir.

A next step 102 includes applying the fluid to the actuator cylinder such that the pressure in the cylinder begins to rise to operate the actuator piston to open the gas exchange valve from a seated position.

A next step 104 includes monitoring a pressure of the fluid by a controller to provide feedback about the operation of the gas exchange valve. A single inexpensive pressure transducer located near the hydraulic supply source would allow monitoring of each actuator, since actuators are independently and non-coincidentally operated by the hydraulic supply pump. The hydraulic pressure in real-time reflects the load conditions at the actuator approximately for this system from the cylinder gas pressures, spring forces, and/or dynamic forces. At certain times this hydraulic pressure could also allow determination of certain absolute engine parameters such as cylinder gas pressures.

Figure 41:
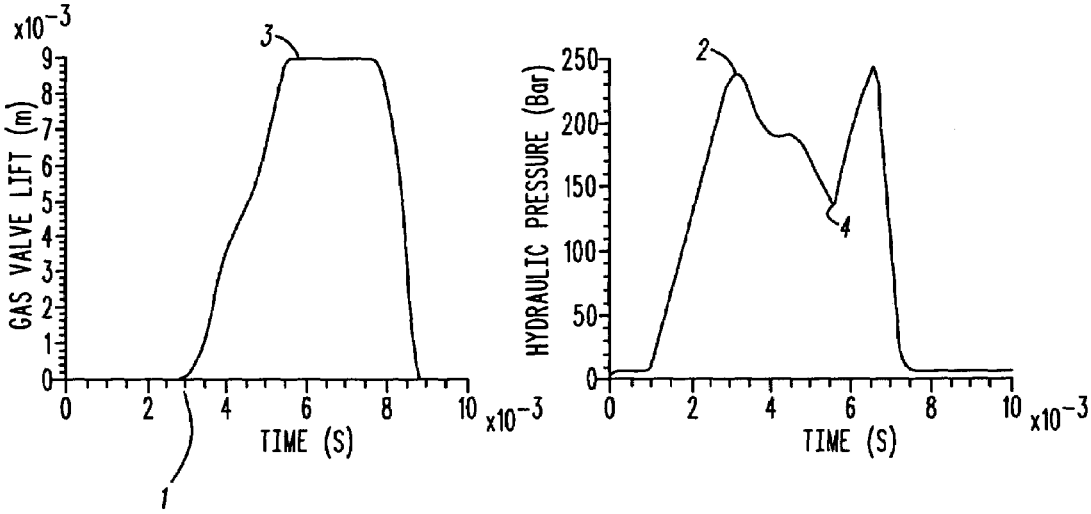
FIG. 41 is a graphical representation of pressure during a valve event.

For example, pressure data such as shown in FIG. 41 would be available for control, diagnostics, and other useful purposes. By monitoring hydraulic pressure for a given valve actuation event (they are independently and sequentially operated), various time constants and events can be determined. For example, a maximum pressure is reached (2) initially in a valve event coinciding with the initial cracking of the valve off its seat (1). This maximum pressure can be used to calculate initial static cylinder gas pressure. When a time delta is calculated to point (4), it allows a constant to be determined equal to the valve opening time. Such a constant is valuable for improved open-loop control. This point could be recognized in a variety of ways using integration, differentiation, etc. of the data. The pressure rise-rate after (4) is a recognizable signature of zero valve motion because of constant-volume fluid compression. These are some example means of utilization of this information which is uniquely available in the valve actuation system of the present invention.

A last step 106 includes using the monitored pressure of the fluid for variable motion control of the gas exchange valve.

CONCLUSION

An "EHOCVA" valve actuation system has been described and its feasibility demonstrated by simulation. In addition, the power efficiency benefits have been quantified. Careful consideration was taken towards the delay of actuation due to oil compression. This results from inherent low-pressure modes of the pump between valve events, which is where the low power consumption advantage lies. In the course of the simulation, analysis of the dynamic behavior of the assumed mechanical design concludes that the present invention has the potential of meeting real world performance specifications, with a significant advantage in power consumption.

Simulation results included direct quantitative comparison of comparable constant-pressure systems with the present invention. Conclusions of that comparison suggest that this system of the present invention could require as little as 1.1 kW of power input for a 4-cylinder engine system at 2000 RPM, compared to 6.1 kW for the assumed comparable constant-pressure system.

Several auxiliary designs and concepts were considered and analyzed in the present invention, with conclusions made among the discussion of each particular one. One example is a valve actuation piston which provides high forces initially, then travels at a second higher rate of speed in a second stage of travel. Analysis conclusions are that the piston design would be most justifiable in larger diesel engines with high cylinder gas forces and high valve lifts, independent of system type. Other concepts considered are a potential high-speed solenoid and system volume reduction strategies for improved pressure rise-rate in this system.

From a cost and reliability standpoint, the system should be very competitive because of the quantity and type of components used. Some competitive systems in the industry use valve position sensors for accurate lift control, extra high-frequency valves for pump unloading (to improve efficiency), variable-displacement pumps, or even accumulators and energy recovery devices. Most, if not all, or these options are more expensive and mechanically complex in comparison.

Although the present invention has not been tested with respect to actual performance in actual conditions and microcomputer controllability, the advantages have been proven in the areas of power efficiency and tolerance to variability of oil temperature. Trends toward high-output, downsized 4, 5, and 6-cylinder engines create an ideal market for this proposed system.

While the present invention has been particularly shown and described with reference to particular embodiments thereof, it will be understood by those skilled in the art that various changes may be made and equivalents substituted for elements thereof without departing from the broad scope of the invention. In addition, many modifications may be made to adapt a particular situation or material to the teachings of the invention without departing from the essential scope thereof. Therefore, it is intended that the invention not be limited to the particular embodiments disclosed herein, but that the invention will include all embodiments falling within the scope of the appended claims.

What is claimed is:

1. An apparatus for hydraulically actuating a gas exchange valve, the apparatus comprising:

a fluid source coupled with a fluid reservoir, the fluid source operable to provide a a low-pressure, substantially constant flow of fluid;

at least one actuator cylinder coupled with the fluid source, the actuator cylinder containing an actuator piston therein coupled to the gas exchange valve, the actuator piston operable to slide within the actuator cylinder upon application of pressure from the fluid applied thereto from the source for actuating the gas exchange valve;

a fluid supply line coupled between the fluid source and the actuator cylinder;

a pressure sensor connected to the fluid supply line;

a controller that inputs a signal from the pressure sensor, the controller controls the application of fluid to the actuator cylinder such that the pressure in the cylinder begins to rise to operate the actuator piston to open the gas exchange valve from a seated position, the controller monitors a pressure of the fluid to provide feedback about the operation of the gas exchange valve, and uses the monitored pressure of the fluid for variable motion control of the gas exchange valve; and an inlet device disposed before the actuator cylinder, the inlet device having at least two operable stages, wherein when switched by the controller to operate in a first stage, the inlet device allows low-pressure fluid from the fluid source to freely pass through the inlet device, and when switched by the controller to operate in a second stage, the inlet device directs the low-pressure fluid to the actuator cylinder such that the low-pressure fluid is applied to the actuator cylinder to operate the actuator piston to open the gas exchange valve from the seated position.

2. The apparatus of claim 1, further comprising an outlet device after each at least one actuator cylinder, the outlet device having two operable stages, a first stage wherein the outlet device closes off flow from the actuator cylinder, and a second stage wherein the outlet device allows fluid from the actuator cylinder to pass therethrough.

3. The apparatus of claim 2, wherein the at least one actuator cylinder includes a plurality of actuator cylinders each with a associated outlet device, the outlet devices are mechanically coupled in parallel from each actuator cylinder to a fluid reservoir, wherein each outlet device operating in the second stage passes fluid to the reservoir.

4. The apparatus of claim 2, further comprising a hydraulic snubber coupled between an outlet of the actuation cylinder and the outlet device.

5. The apparatus of claim 1, further comprising an outlet device after each at least one actuator cylinder, the outlet device having two operable stages, a first stage wherein the outlet device closes off flow from the actuator cylinder, and a second stage wherein the outlet device allows fluid from the actuator cylinder to pass therethrough, and wherein the inlet and outlet devices can be switched to their respective first stages to hold the gas exchange valve at any one of a range of positions.

6. The apparatus of claim 5, wherein the inlet and outlet devices can be switched to their respective second stages to provide fluid flow through the actuator cylinder to purge air from the system.

7. The apparatus of claim 5, wherein the inlet and outlet devices are solenoid-driven, spring-loaded spool valves under control of the controller.

8. An apparatus for hydraulically actuating a gas exchange valve, the apparatus comprising:

a fluid source coupled with a fluid reservoir, the fluid source operable to provide a substantially constant flow of fluid;

a plurality of actuator cylinders each coupled with the fluid source, each actuator cylinder containing an actuator piston therein coupled to the gas exchange valve, the actuator piston operable to slide within the actuator cylinder upon application of pressure from the fluid applied thereto from the fluid source for actuating the gas exchange valve;

a fluid supply line coupled between the fluid source and each actuator cylinder;

a pressure sensor connected to the fluid supply line;

a controller that inputs a signal from the pressure sensor, the controller controls the application of fluid to each actuator cylinder such that the pressure in the cylinder begins to rise to operate the actuator piston to open the gas exchange valve from a seated position, the controller monitors a pressure of the fluid to provide feedback about the operation of the gas exchange valve, and uses the monitored pressure of the fluid for variable motion control of the gas exchange valve; and a plurality of inlet devices, wherein each actuator cylinder has an associated inlet device disposed before the actuator cylinder, the inlet device having at least two operable stages, the inlet devices being mechanically coupled in series along the fluid supply line, wherein the inlet devices operating in a first stage freely pass low-pressure fluid to the next inlet device in the fluid supply line with the last inlet device in the line passing the fluid to the reservoir, and wherein when the inlet device is operating in a second stage, the fluid is directed through the inlet device to the actuator cylinder.

9. The apparatus of claim 3, further comprising a switchable pressure valve coupled on an outlet of the fluid supply line, wherein the pressure valve is switchable between a first stage that allows the free flow of fluid to the reservoir and a second stage which forces the fluid through a pressure regulator to increase the operating pressure of the fluid in the apparatus.

10. An apparatus for hydraulically actuating a gas exchange valve, the apparatus comprising:

a fluid source coupled with a fluid reservoir, the fluid source operable to provide a low-pressure, substantially constant flow of fluid;

at least one actuator cylinder coupled with the fluid source, the actuator cylinder containing an actuator piston therein coupled to the gas exchange valve, the actuator piston operable to slide within the actuator cylinder upon application of pressure from the fluid applied thereto from the fluid source for opening the gas exchange valve with a return spring used for closing the gas exchange valve;

a fluid supply line coupled between the fluid source and the actuator cylinder;

an outlet device coupled to an outlet of the actuator cylinder, the outlet device having two operable stages, a first stage wherein the outlet device closes off flow from the actuator cylinder, and a second stage wherein the outlet device allows fluid from the actuator cylinder to pass therethrough to the reservoir;

a pressure sensor connected to the fluid supply line;

a controller that inputs a signal from the pressure sensor, the controller controls the application of fluid to the actuator cylinder such that the pressure in the cylinder is continuously variable to operate the actuator piston to open the gas exchange valve from a seated position, the controller monitors a pressure of the fluid to provide feedback about the operation of the gas exchange valve, and uses the monitored pressure of the fluid for variable open-loop motion control of the gas exchange valve; and an inlet device disposed before the actuator cylinder, the inlet device having at least two operable stages, wherein when switched by the controller to operate in a first stage, the inlet device allows low-pressure fluid from the fluid source to freely pass through the inlet device while blocking any return flow from the actuator cylinder, and when switched by the controller to operate in a second stage, the inlet device directs the low-pressure fluid to the actuator cylinder such that the low-pressure fluid is applied to the actuator cylinder to operate actuator piston to open the gas exchange valve from the seated position.

11. The apparatus of claim 10, wherein the feedback is used to control the at least one actuator cylinder and to provide operational parameters of the system.

12. An apparatus for hydraulically actuating a gas exchange valve, the apparatus comprising:

a fluid source coupled with a fluid reservoir, the fluid source operable to provide a low-pressure, substantially constant flow of fluid;

a plurality of actuator cylinders coupled with the fluid source, each actuator cylinder containing an actuator piston therein coupled to the gas exchange valve, the actuator piston operable to slide within the actuator cylinder upon application of pressure from the fluid applied thereto from the fluid source for opening the gas exchange valve with a return spring used for closing the gas exchange valve;

a fluid supply line coupled between the fluid source and each actuator cylinder;

a plurality of inlet devices coupled to the fluid supply line, wherein each actuator cylinder has an associated inlet device, the inlet device having at least two operable stages, the inlet devices being mechanically coupled in series along the fluid supply line, wherein the inlet devices operating in a first state freely pass low-pressure fluid to the next inlet device in the fluid supply line with the last inlet device in the line passing the fluid to the reservoir, and wherein when the inlet device is operating in a second stage, the fluid is directed through the inlet device to the actuator cylinder; a plurality of outlet devices, wherein each actuator cylinder has an associated outlet device coupled to an outlet of the actuator cylinder, the outlet device having two operable stage, and the outlet devices being mechanically coupled in parallel from each actuator cylider to the reservoir, wherein in first stage, the outlet device closes off flow from the actuator cylinder, and wherein each outlet device operating in a second stage passes fluid to the reservoir;

a pressure sensor connected to the fluid supply line; and a controller that inputs a signal from the pressure sensor, the controller controls the application of fluid to each actuator cylinder such that the pressure in the cylinder is continuously variable to operate the actuator piston to open the gas exchange valve from a seated position, the controller monitors a pressure of the fluid to provide feedback about the operation of the gas exchange valve, and uses the monitored pressure of the fluid for variable open-loop motion control of the gas exchange valve.

13. The apparatus of claim 12, wherein the inlet and outlet devices can be switched to their respective first stages to bold the gas exchange valve at any one of a range of positions.

14. A method of hydraulically actuating a gas exchange valve, the method comprising the steps of:

providing a fluid from a low-pressure, substantially constant flow source to an actuator cylinder, the actuator cylinder containing an actuator piston therein coupled to the gas exchange valve, the actuator piston operable to slide within the actuator cylinder upon application of pressure from the fluid applied thereto for actuating the gas exchange valve, and further providing a controller and an inlet device disposed before the actuator cylinder, the inlet device having at least two operable stages, wherein when switched by the controller to operate in a first stage, the inlet device allows low-pressure fluid from the fluid source to freely pass through the inlet device, and when switched by the controller to operate in a second stage, the inlet device directs the low-pressure fluid to the actuator cylinder such that the low-pressure fluid is applied to the actuator cylinder to operate the actuator piston to open the gas exchange valve from a seated position;

using the controller to control the application of fluid to the actuator cylinder such that the pressure in the cylinder begins to rise to operate the actuator piston to open the gas exchange valve from the seated position;

monitoring a pressure of the fluid to provide feedback about the operation of the gas exchange valve; and using the monitored pressure of the fluid for motion control of the gas exchange valve.

15. The method of claim 14, wherein the providing step includes providing an outlet device after the actuator cylinder, the outlet device having two operable stages, a first stage wherein the outlet device closes off flow from the actuator cylinder, and a second stage wherein the outlet device allows fluid from the actuator cylinder to pass therethrough.

16. The method of claim 15, wherein the providing step includes providing a plurality of actuator cylinders each with an associated outlet device, the outlet devices are mechanically coupled in parallel along the fluid supply line wherein each outlet device operating in the second stage passes fluid to the reservoir.

17. The method of claim 14, wherein the providing step includes providing an outlet device after the actuator cylinder, the outlet device having two operable stages, a first stage wherein the outlet device closes off flow from the actuator cylinder, and a second stage wherein the outlet device allows fluid from the actuator cylinder to pass therethrough, and further comprising the step of switching the inlet and outlet devices to their respective first stages to hold the gas exchange valve at any one of a range of positions.

18. A method of hydraulically actuating a gas exchange valve, the method comprising the steps of;

providing a fluid from substantially constant flow source to an actuator cylinder, the actuator cylinder containing an actuator piston therein coupled to the gas exchange valve, the actuator piston operable to slide within the actuator cylinder upon application of pressure from the fluid applied thereto for actuating the gas exchange valve, and further providing a plurality of actuator cylinders each with an associated inlet device, the inlet device having at least two operable stages, and the inlet device being mechanically coupled in series along the fluid supply line, wherein the inlet devices operating in a first stage freely pass low-pressure fluid to the next inlet device in the fluid supply line with the last inlet device in the line passing the fluid to the reservoir, and wherein when the inlet device is operating in a second stage, the fluid is directed through the inlet device to die actuator cylinder;

applying the fluid to the actuator cylinder such that the pressure in the cylinder begins to rise to operate the actuator piston to open the gas exchange valve from a seated position;

monitoring a pressure of the fluid to provide feedback about the operation of the gas exchange valve; and using the monitored pressure of the fluid for motion control of the gas exchange valve.

* * * * *